United States Patent [19]

Sandhaus

[11] Patent Number: 4,550,841

[45] Date of Patent: Nov. 5, 1985

[54] CLOSURE HAVING INTEGRAL FORMED SEALING MEANS

[76] Inventor: Jeffrey Sandhaus, Rte. 9W, Snedens Landing, N.Y. 10964

[21] Appl. No.: 549,477

[22] Filed: Nov. 7, 1983

Related U.S. Application Data

[63] Continuation-in-part of Ser. No. 441,546, Nov. 15, 1982, Pat. No. 4,479,585, which is a continuation-in-part of Ser. No. 399,237, Jul. 19, 1982, Pat. No. 4,442,945, which is a continuation-in-part of Ser. No. 335,216, Dec. 28, 1981, Pat. No. 4,413,742.

[51] Int. Cl.[4] ..... B65D 55/02

[52] U.S. Cl. ..... 215/211; 215/320; 215/329

[58] Field of Search ..... 215/211, 301, 320, 329, 215/214

[56] References Cited

U.S. PATENT DOCUMENTS 4,087,016 5/1978 Towns et al. ..... 215/211

4,257,526 3/1981 Weits et al. ..... 215/320

*Primary Examiner*—George T. Hall

*Attorney, Agent, or Firm*—Kenyon and Kenyon

[57] ABSTRACT

A closure for a container includes a closed top, a peripheral skirt and an integral engagement portion which extends from the closure top having an outer sidewall which is spaced radially inwardly from the inner sidewall of the skirt a distance sufficient such that the container neck is receivable in the space therebetween. A mechanism is provided by which the engagement portion is expanded radially outwardly either during or after the application of the closure to the container to urge the sidewall of the engagement portion tightly into engagement with the inner sidewall of the container neck to provide a friction locking and/or hermetic sealing of the closure to the container. In another embodiment, locking means are provided on the inner sidewall of the closure skirt which allows the closure to be twisted onto the container but which prevents the closure from being twisted in the opposite direction thereby locking the closure onto the container. A mechanism for selectively disengaging the locking means from the container is provided when access to the container contents is desired. Other embodiments using the principles of the invention are also disclosed.

10 Claims, 40 Drawing Figures

FIG. 1
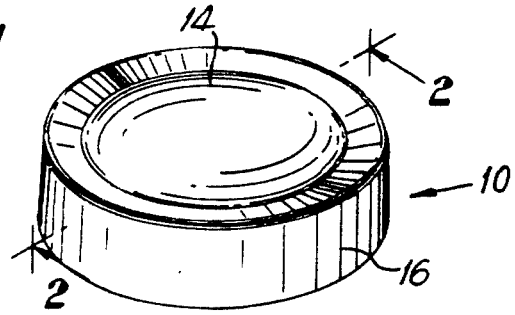
FIG. 2
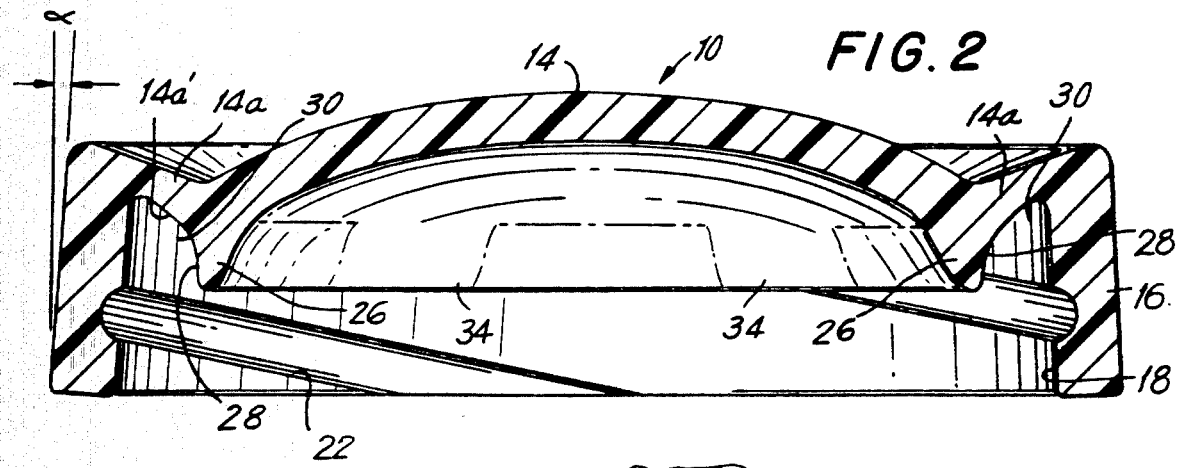
FIG. 4A
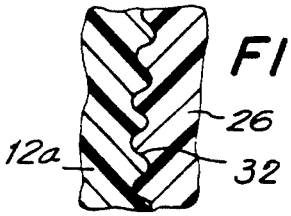
FIG. 3
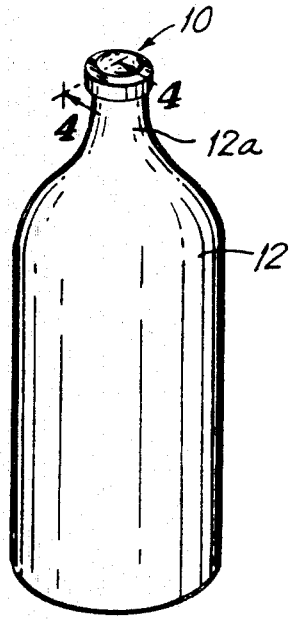
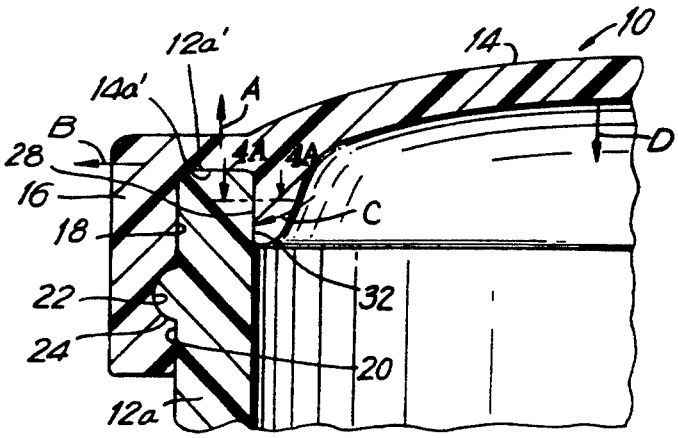
FIG. 4

FIG. 5
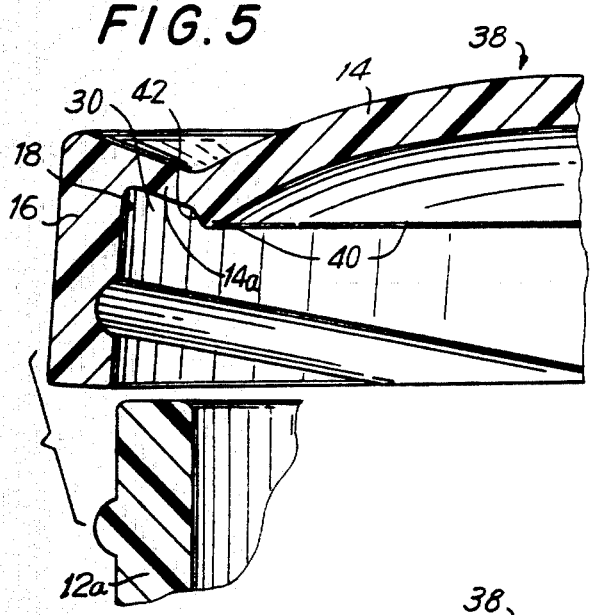
FIG. 8
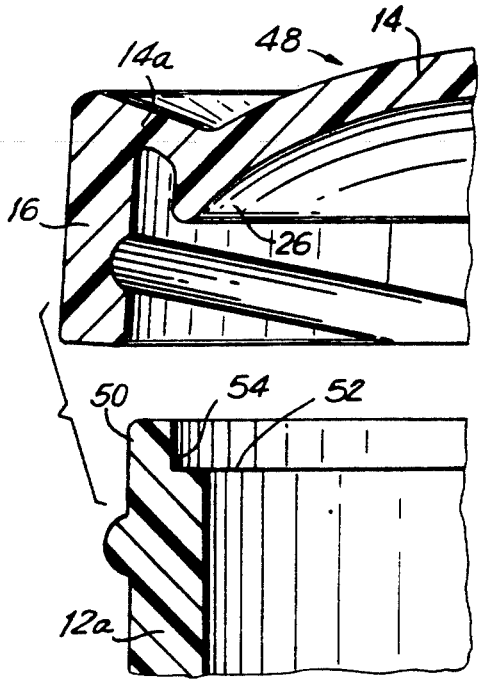
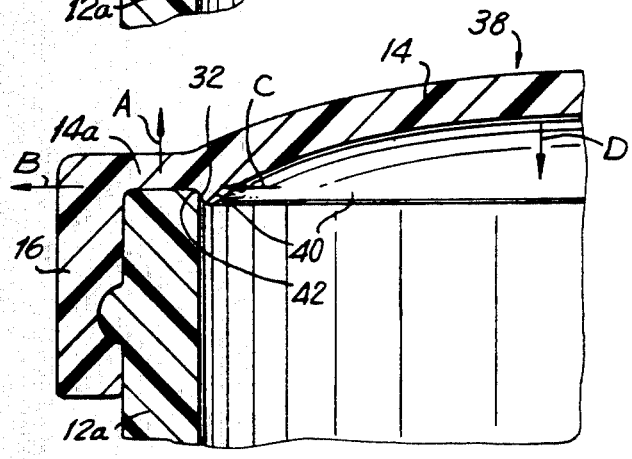
FIG. 6
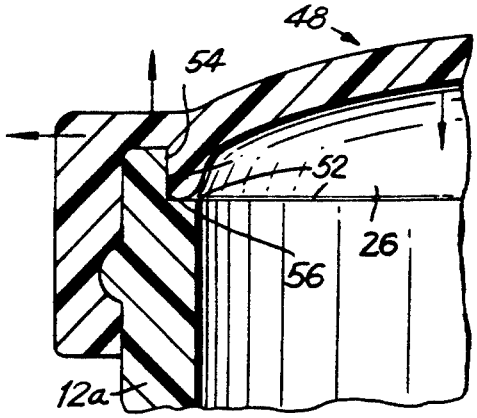
FIG. 9
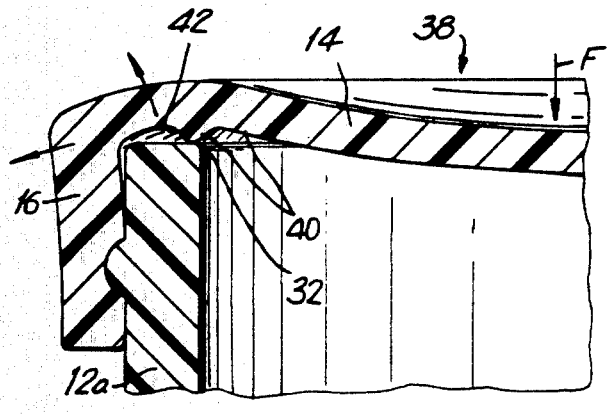
FIG. 7

FIG. 18
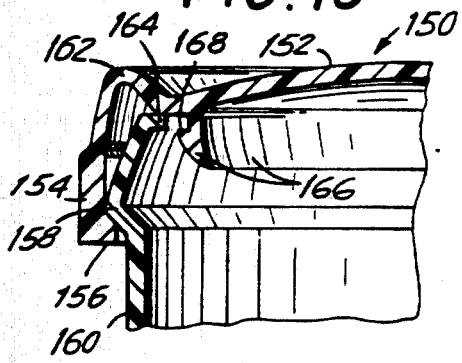
FIG. 19
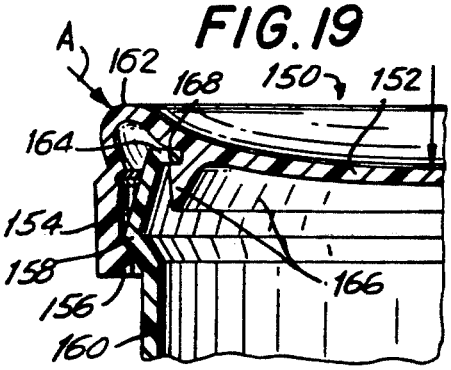
FIG. 30
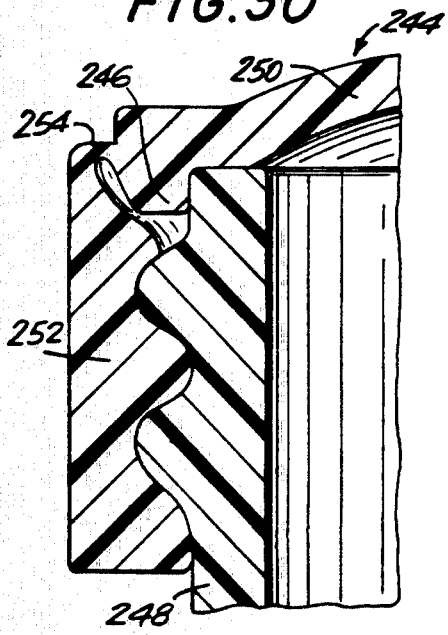
FIG. 31
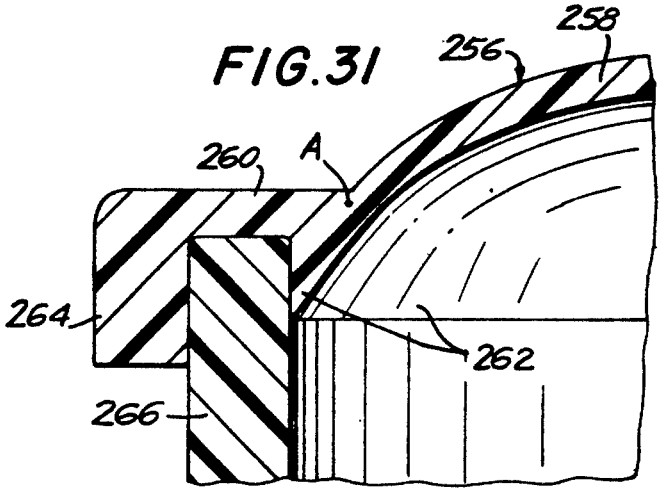
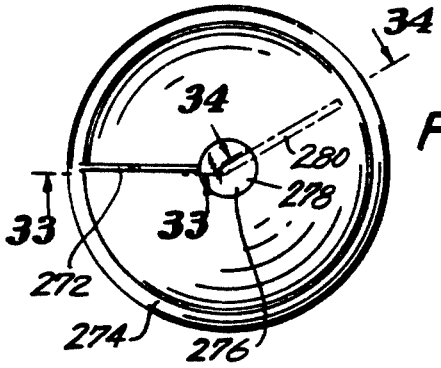
FIG. 32
FIG. 33
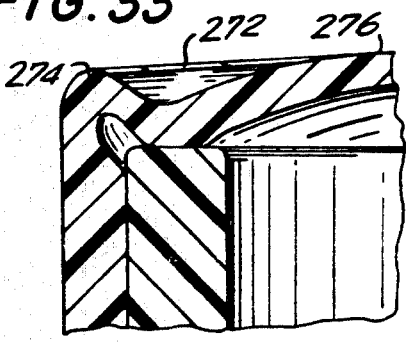
FIG. 34
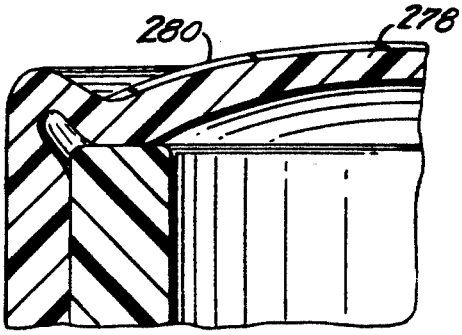

FIG. 22
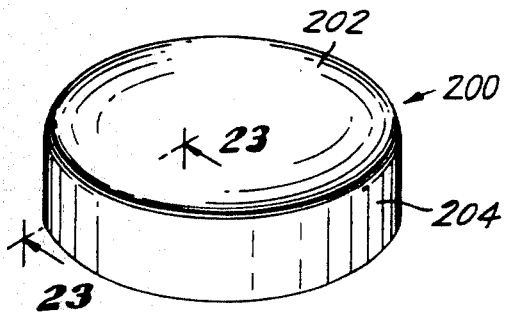
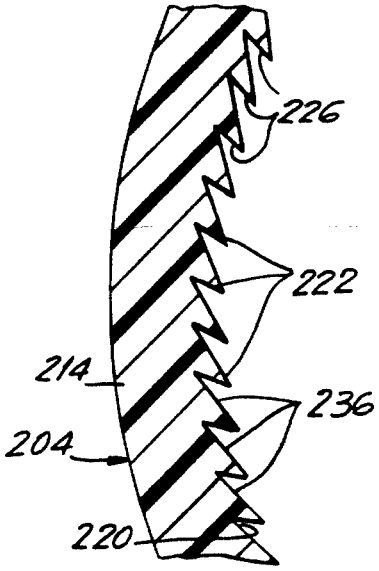
FIG. 24
FIG. 23
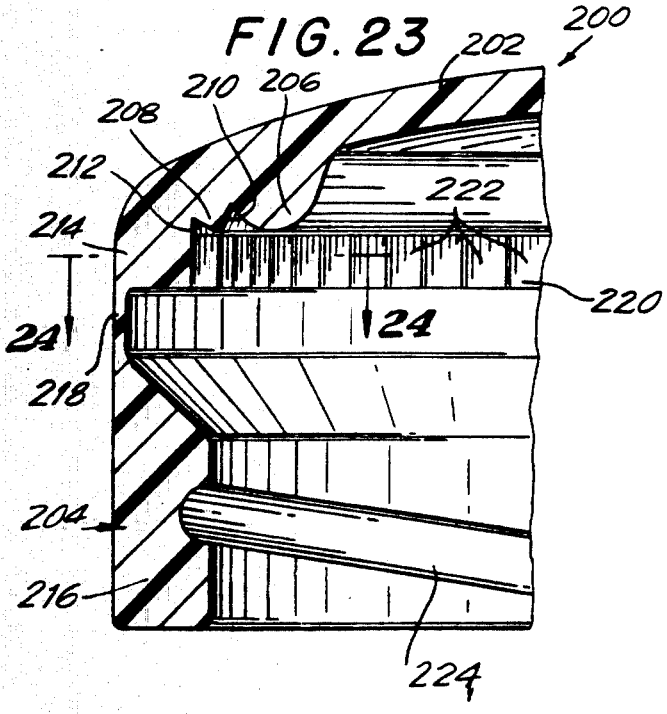
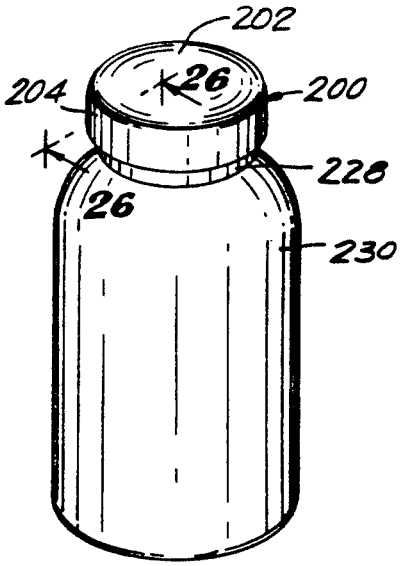
FIG. 25

FIG. 35
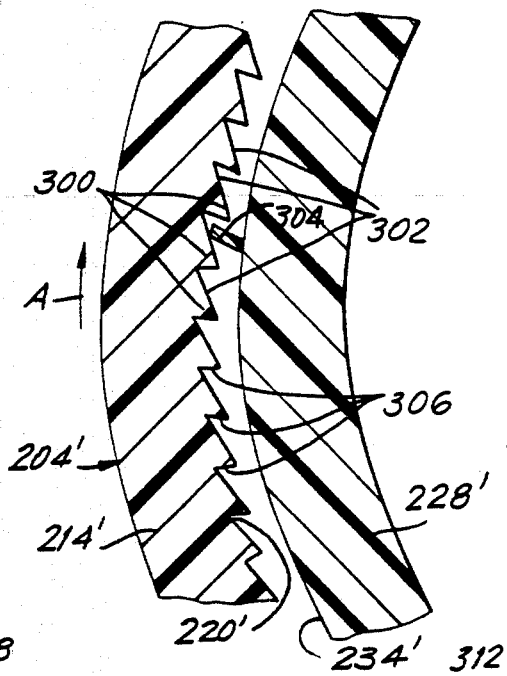
FIG. 36
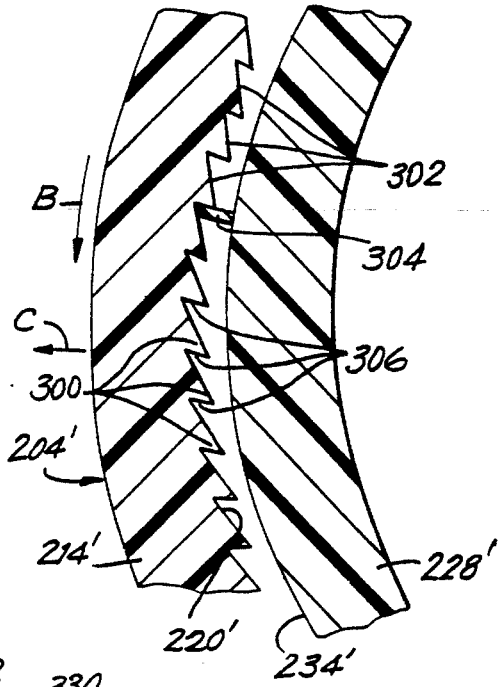
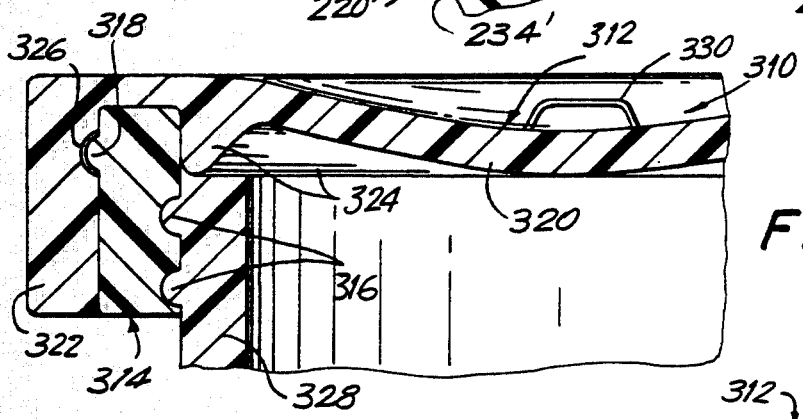
FIG. 37
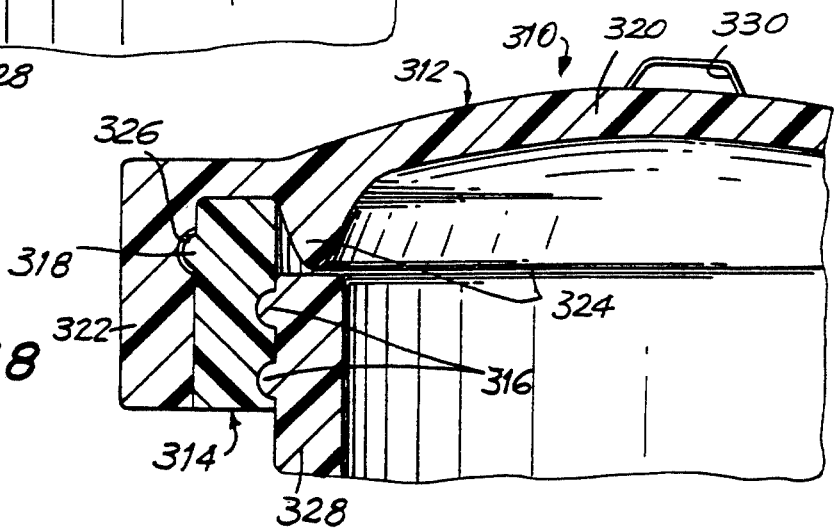
FIG. 38

CLOSURE HAVING INTEGRAL FORMED SEALING MEANS

BACKGROUND OF THE INVENTION

This application is a continuation-in-part of application Ser. No. 441,546 filed Nov. 15, 1982, now U.S. Pat. No. 4,479,585 which is a continuation-in-part of application Ser. No. 399,237 filed July 19, 1982, now U.S. Pat. No. 4,442,945 which is a continuation-in-part of application Ser. No. 335,216 filed Dec. 28, 1981 now U.S. Pat. No. 4,413,742.

The present invention relates generally to closures for containers and, more particularly, to safety, i.e., childproof, closures, closures for hermetically sealing containers, tamper-resistant closures, and closures which combine two or more of the safety, hermetic sealing and tamper-resistant functions.

It is desirable and in some cases legally required to provide a closure for containers which will prevent children from obtaining access to dangerous contents, such as medicines, insecticides, cleaners and other toxic household substances, contained therein. Thus, safety or childproof closures have been suggested which are intended to close a container in a manner so as to make it difficult for a child to remove the closure from the container, either intentionally or through inadvertence. Generally, known safety closures must be manipulated in a certain fashion in order to unlock the same from the container to permit its subsequent removal. For example, reference is made to the safety closures disclosed in U.S. Pat. Nos. 3,182,840 to Polzin, 3,514,003 to Fitzgerald, 4,106,651 to Lemons, 4,187,953 to Turner and 3,853,237 to Marchant.

However, known safety closures are not entirely satisfactory in use and/or in manufacture. In general, a safety closure should incorporate features which are desirable both from the standpoints of operation as well as manufacture. One desirable feature is that removal of the closure from the container should be possible without requiring maneuvers which are so complicated as to make it difficult for adults, elderly individuals or infirm individuals, to obtain ready access to the contents of the container, yet which are sufficiently difficult to prevent children from removing the closure.

The safety closure should be readily adaptable for use with a wide range of container types and sizes thereby providing an applicability to virtually all packaging styles. However, most safety closures are particularly adapted for use with only certain types of containers. For example, the design of known safety closures typically dictates that the closure be either a threaded or snap-type closure.

In connection with the manufacture of safety closures, it is desirable that the basic design be relatively simple in construction and manufacture. Moreover, it is of course preferable that the closure need not require complicated and therefore expensive molds, or molds which require significant maintenance.

The closure should be reliable and meet all requirements for reliably preserving and storing pharmaceutical and household substances in both liquid and solid form.

Most conventional safety closures also require that the neck of the container to which they are applied be structurally modified to provide the safety locking feature. This is a considerable drawback in that such safety closures cannot be used with containers which are not so structurally modified. Likewise, containers which have been modified for use with a particular type of safety closure cannot be used with closures of different types.

Another desirable feature of a closure, whether of the safety type or otherwise, is that the closure be provided with means for inhibiting unauthorized tampering with the contents of the container prior to the first legitimate removal of the closure therefrom.

In cases where it is desirable or necessary to store the contents of a container under a pressure which is either greater or less than atmospheric, such for example as carbonated beverages, the closure must provide a good hermetic seal. Moreover, when the contents of the container are not exhausted after the intial opening of the container, it is evident that the closure should be capable of reestablishing the over or under pressure as well as the hermetic seal upon being reapplied to the container. Conventional closures having such capabilities are usually of a relatively complicated design and are therefore costly in manufacture. Although closures intended to provide a hermetic seal are known which are of more or less simple construction, such closures often do not provide a reliable hermetic seal, especially after repeated use.

Finally, it may under certain circumstances be advantageous to provide a closure which is capable of functioning simultaneously both as a safety or childproof closure, with or without a tamperevident capability, while at the same time providing a hermetic seal capability for the contents of the container. To applicant's knowledge, such a closure is not presently available which reliably provides all of the desirable features enumerated above.

SUMMARY OF THE INVENTION

Accordingly, it is a main object of the present invention to provide new and improved closures which have one or more of the desirable features mentioned above and which do not suffer from the various above-mentioned drawbacks.

More particularly, one object of the present invention is to provide new and improved closures of the safety or childproof type having a design which affords one or more of the following characteristics, namely, reliability in operation, a mechanism for effecting unlocking which is of a suitable degree of difficulty, the ability to be designed in the form of either a threaded or snap-type closure, simplicity in construction and economy and ease in manufacture, and wherein the closure does not require any modification in the neck of a conventional container.

Another object of the present invention is to provide new and improved closures of the tamper-resistant type wherein a readily visual indication is provided upon the initial removal of the closure from the container indicative of that occurrence, and wherein the closure does not require any modification to be made in the neck of a conventional container to which it is applied.

Still another object of the present invention is to provide new and improved closures of the type which provide a hermetic seal, the closures being simple in construction and manufacture and capable of reestablishing an overpressure or underpressure and reliable hermetic seal upon reapplication to the container.

An important object of the present invention is to provide a new and improved closure which constitutes both a safety or childproof closure, with or without a tamper-evident capability, as well as a closure which provides a reliable hermetic seal.

Briefly, in accordance with the present invention, these and other objects are attained by providing a closure having a unitary or one-piece construction including a closed top and an integral peripheral skirt having an inner sidewall adapted to fit over the outer sidewall of the neck of the container on which the closure is applied. The closure may be a threaded closure adapted to be screwed onto the container neck or may be a snap-type closure as more fully described below.

According to one main form of the invention, the closure is provided with engagement means which extend downwardly from the closure top, the engagement means having an outer sidewall which is spaced radially inwardly from the inner sidewall of the closure skirt a sufficient distance such that the container neck will be receivable in the space therebetween. The closure configuration provides a mechanism by which the engagement means are expanded radially outwardly either during or after the application of the closure to the container to urge the sidewall of the engagement means tightly into engagement with the inner sidewall of the container neck.

In several of the disclosed embodiments, the engagement means are constituted by an engagement ring integral with and extending downwardly from the closure top. The outer sidewall of the engagement ring is spaced radially inwardly from the inner sidewall of the closure skirt around its circumference to define, together with a portion of the closure top, an annular channel in which the neck of the container is received when the closure is applied thereto. Either during or after the application of the closure to the container, the engagement ring is expanded so that its diameter increases radially outwardly to an extent sufficient to urge the sidewall of the ring tightly into engagement with the inner sidewall of the container neck continuously around its entire circumference.

The nature and degree of tightness of the engagement of the outer sidewall of the engagement means with the inner sidewall of the container neck and the manner for effecting engagement and disengagement of the engagement means and neck sidewalls are selectively determined by the particular construction of the closure to provide the closure with a childproof, i.e., safety, and/or hermetic sealing capability.

In the case where the closure is to function as a safety or childproof closure, the nature and degree of tightness of the engagement between the sidewalls of the engagement means and the container neck are selected such that removal of the closure from the container is prevented by the friction forces created between the engaged sidewalls of the expanded engagement means and the container neck. Moreover, the closure is designed in a certain manner to provide a degree of difficulty to effect disengagement of the sidewalls to thereby allow removal of the closure from the container. When so constructed, the closure functions as a safety closure to prevent access to the contents of the container by persons not capable of operating the disengagement mechanism, such as children.

As noted above, the closure can be constructed such that the nature and degree of tightness of the engagement means with the inner sidewall of the container neck provides an airtight or hermetic seal. In this connection, the engagement means are constituted by the engagement ring described above while a tight engagement of the sidewalls of the engagement ring and container neck is achieved continuously over the entire circumference of the neck. Moreover, the closure can be constructed such that the hermetic seal is provided either in combination with the above-described safety or childproof features or in lieu thereof.

The mechanism by which the engagement means are expanded so that its diameter increases radially outwardly to effect the desired engagement with the inner sidewall of the container neck can take any one of several forms. Thus, the closure may be configured such that as the cap is applied to the container, the closure in the region of the engagement means is deformed in a manner such that the engagement means expands. Alternatively, the closure may be formed to include a deformable actuation portion which is actuated after application of the closure to the container to expand the engagement means. In order to facilitate and in some embodiments actuate the expansion of the engagement means radially outwardly into engagement with the inner sidewall of the neck, the closure top has a configuration other than planar and, most preferably, has either a convex or concave configuration.

More particularly, in accordance with certain embodiments of the main form of the invention described above, a space or annular channel (in the case where the engagement means are constituted by an engagement ring) defined by the closure top together with the inner and outer sidewalls of the closure skirt and the engagement means has a certain configuration such that upon application of the closure to the container, the portion of the container neck received in the channel acts against the channel-defining surfaces to automatically cause the closure, at least in the region of the engagement means, to deform so that the engagement means expands until the outer sidewall thereof is urged tightly into engagement with the inner sidewall of the container neck. In these embodiments of the invention, the expansion of the engagement means is facilitated by a non-planar configuration of the closure top which is provided with sufficient flexibility so that the forces resisting the deformation are to a large extent absorbed by the closure top which is able to flex under such forces thereby reducing the effort required to produce the required deformation.

In accordance with certain other embodiments of the main form of the invention described above, the radially outward expansion of the engagement means whereby its outer sidewall is urged into engagement with the inner sidewall of the container neck is effected after the application of the closure to the container by deforming a non-planar top of the closure. For example, the closure top may have a normally convex configuration. After application of the closure to the container, the top is pushed downwardly under finger pressure which in turn causes the engagement means to expand outwardly to engage the inner sidewall of the container neck. These embodiments (wherein the engagement means are constituted by an engagement ring) are especially advantageous in providing a pressurized hermetic seal for certain types of foods, such as beverages, since an overpressure will be created within the container upon the closure top snapping from its convex into a concave configuration and since a hermetic seal is simultaneously provided by the expansion of the engagement ring into engagement with the container neck, the overpressure will be maintained. The closure can be designed to require the application of a certain minimum force to deform a deformable portion of the closure to effect disengagement of the engagement ring from the container neck thereby providing the hermetic closure with a childproof capability.

In the case where the closure functions as a safety or childproof closure, removal of the closure from the container may be accomplished in any one of several ways. For example, the closure can be designed such that the friction forces are not so great as to prevent removal by an adult. Alternatively, means for positively disengaging the sidewalls can be provided. For example, the closure can be designed so that a certain minimum force is required to effect deformation of a deformable closure portion, such as the closure top, which in turn will effect disengagement of the engagement means from the inner sidewall of the container neck. The minimum force required to effect such deformation is preferably greater than that which a child can exert.

In one embodiment, the closure is constructed with a normally convex top which is flexed to a somewhat less convex configuration upon closure application and engagement means expansion. When it is desired to disengage the engagement means from the inner sidewall of the container neck, the closure top is deformed by finger pressure which results in a radial contraction of the engagement means to a position where the sidewalls are disengaged.

According to another main form of the invention which, unlike the form described above, is applicable essentially only to threaded safety closures adapted to be screwed onto a container neck, locking means are provided on the inner sidewall of the closure skirt, preferably extending around the entire periphery thereof. The closure is constructed such that although the locking means does not prevent the closure from being screwed onto the container neck by twisting the closure in one direction, the locking means cooperates with means on the outer sidewall of the container neck to prevent the closure from being twisted in the opposite direction, thereby essentially locking the closure onto the container. The closure is provided with a disengaging mechanism for selectively disengaging the locking means from the outer sidewall means of the container neck when it is desired to obtain access to the container contents.

The locking means may take the form of friction locking means and in an illustrated embodiment a plurality of flexible teeth or saw-tooth serrations are provided on the inner sidewall of the closure skirt to engage the outer sidewall of the container to function as described above. In another embodiment, the locking means is constituted by ratchet teeth provided on the skirt inner sidewall adapted to engage a pawl provided on the container.

The mechanism for disengaging the locking means may comprise a deformable portion of the closure, such as the closure top, which, when deformed, moves the locking means radially outwardly. By forming the closure to require a certain minimum force in order to deform the closure top, a reliable safety closure is obtained.

Any of the safety and hermetic closures of the invention may be provided with a tamper-evident feature which is applicable to a closure whose contour or configuration must be altered or changed in connection with the effecting its removal from the container. For example, in the case of a closure having a convex top which is depressed to effect unlocking from the container, a non-pliable, frangible substance, such as a thin film of lacquer or the like, may be applied to the upper surface of the closure top. Alternatively, a frangible portion may be formed integrally with the closure between regions which are flexed with respect to each other to effect unlocking. Upon the first or initial depression of the closure top, the film or portion will visibly fracture, split, crack, spider or separate from the closure to provide a visual indication that the closure has at some time already been removed or at least unlocked from the container.

DESCRIPTION OF THE DRAWINGS

A more complete appreciation of the present invention and many of the attendant advantages thereof will be readily understood by reference to the following detailed description when considered in connection with the accompanying drawings in which:

FIG. 1 is a perspective view of a closure according to a first embodiment of a main form of the present invention;

FIG. 2 is a section view taken along line 2—2 of FIG. 1;

FIG. 3 is a perspective view illustrating the closure of FIG. 1 applied to a container;

FIG. 4 is a section view taken along line 4—4 of FIG. 3;

FIG. 4A is a sectional view taken along line 4A—4A of FIG. 4 illustrating an alternative configuration of the sidewalls of the engagement means and container neck;

FIG. 5 is a partial side sectional view of a closure according to a second embodiment of the main form of the invention prior to its application to the neck of a container, also partially illustrated in the figure;

FIG. 6 is a view similar to FIG. 5 and illustrating the closure applied to the container neck;

FIG. 7 is a view similar to FIGS. 5 and 6 and illustrating the removal of the closure from the container neck;

FIG. 8 is a partial side sectional view of a closure according to a third embodiment of the invention and illustrating the closure prior to its application to the neck of a container, also shown in the figure;

FIG. 9 is a view similar to FIG. 8 and illustrating the closure applied to the container neck;

FIG. 18 is a partial side sectional view of a closure according to a seventh embodiment of the main form of the present invention, the closure being illustrated after application to the container neck and prior to engagement of the engagement means with the container neck;

FIG. 19 is a view similar to FIG. 18 showing the closure subsequent to the engagement of the engagement means with the container neck;

FIG. 22 is a perspective view of a closure according to a second main form of the present invention;

FIG. 23 is a section view taken along line 23—23 of FIG. 22;

FIG. 24 is a section view taken along line 24—24 of FIG. 23;

FIG. 25 is a perspective view of the closure illustrated in FIGS. 22–24 applied to a container;

FIG. 30 is a section view of a closure according to another form of the invention applied to a container;

FIG. 31 is a section view of a container and a closure similar to the closure of FIGS. 5–7 applied thereto wherein the mechanism by which the engagement means are disengaged from the container neck is modified in accordance with the principles of the present invention;

FIG. 32 is a plan view of a closure in accordance with the present invention provided with tamper-evidence features;

FIG. 33 is a section view taken along line 33—33 of FIG. 32;

FIG. 34 is a section view taken along line 34—34 of FIG. 32;

FIG. 35 is a view similar to FIG. 27*a* illustrating another embodiment of a closure according to the second main form of the invention and showing the closure being applied to the container;

FIG. 36 is a view similar to FIG. 35 and illustrating the closure during an attempt to remove the same from the container neck;

FIG. 37 is a partial section view illustrating another form of the invention in an unlocked mode; and FIG. 38 is a partial section view of the embodiment of FIG. 37 in the locked mode.

DESCRIPTION OF THE PREFERRED EMBODIMENTS

Figure 10:
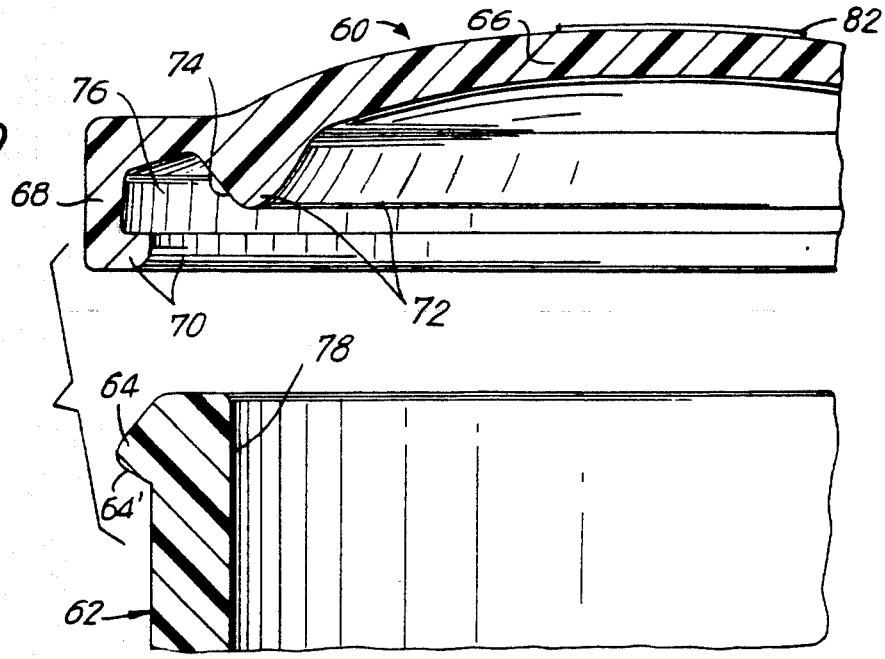
FIG. 10 is a partial side sectional view of a closure according to a fourth embodiment of the main form of the invention and illustrating the closure prior to its application to the neck of a container, also shown in the figure.

Several main forms of the invention are described hereinbelow, embodiments of a first main form being illustrated in FIGS. 1–21 and an embodiment of a second main form being illustrated in FIGS. 22–29 and FIGS. 35 and 36. Additional forms and modifications of the invention are also described hereinbelow.

The closures described herein (unless otherwise specified) are constructed in a one-piece, unitary manner of any suitable semirigid plastic material, preferably a thermoplastic material having a degree of flexibility, such as polyethylene, polypropylene, plasticized polyvinyl chloride or other suitable flexible plastic material. The closures can be manufactured by injection molding or compression molding, or any other suitable plastic forming technique.

Although the embodiments of the closure are described as being applied to the neck of a container, it will be understood that the closure is also applicable to containers which do not have socalled necks, e.g., carafes and the like.

Referring now to the drawings, wherein like reference characters designate identical or corresponding parts throughout the several views, and more particularly to FIGS. 1–4 wherein a first embodiment of the first main form of the invention is illustrated, the closure 10 is particularly suited to providing a childproof safety feature and/or a hermetic seal when applied to the neck 12*a* of a container 12. Although the closure is shown as being of the threaded or screw-type, it is understood that the characterizing features thereof can be equally well applied to a snap-type closure.

Closure 10 includes a closed top 14 and an integral peripheral skirt 16 having an inner sidewall 18 configured to fit over the outer sidewall 20 of the neck 12*a* of container 12. The closure skirt is provided with internal threads 22 adapted to engage the external threads 24 formed on the container neck in a conventional manner.

According to the first main form of the invention, the closure is provided with inner engagement means extending downwardly from the closure top, the engagement means having an outer sidewall which is spaced radially inwardly from the inner sidewall of the closure skirt. In the embodiment illustrated in FIGS. 1–4, the engagement means are constituted by an inner engagement ring 26 which is formed integrally with and extends downwardly from the closure top 14. The engagement ring 26 has an outer sidewall 28 constituting a sealing surface portion which is spaced radially inwardly and equidistantly from the inner sidewall 18 of the closure skirt 16 at all points around its circumference to define, together with an outer portion 14*a* of the closure top 14, an annular channel 30 in which the upper end region of the container neck 12*a* is received when the closure is applied thereto.

The closure 10 is provided with a mechanism by which the engagement ring 26 is expanded radially outwardly as the closure 10 is applied to the container 12 to urge the outer sidewall, i.e., the outer sealing surface portion 28 of engagement ring 26 tightly into engagement with the inner sidewall 32 of the container neck 12*a* continuously around its entire circumference.

In this manner, a tight frictional engagement between the inner and outer sidewalls 32 and 28 of the container neck and engagement ring 12*a* and engagement ring 26 is achieved. This frictional engagement may be sufficient to create a hermetic seal and/or a friction locking of the closure to the container to provide a childproof feature as described below.

The mechanism by which the outer sidewall 28 of engagement ring 26 is brought into engagement with the inner sidewall 32 of the container neck 12*a* is constituted by the particular geometry or configuration of an annular channel 30 defined between the engagement ring 26, the closure skirt 16 and the outer closure top portion 14*a*. As seen in FIG. 2, the inner surface 14*a'* of the closure top portion 14*a* extends downwardly in the radially inward direction when the closure is in its undeformed condition, i.e., prior to the closure being applied to the container, and merges into the sidewall 28 of the engagement ring 26. The major portion of the closure top 14 has a non-planar configuration which in the illustrated embodiment takes the form of a convex, dome-shaped configuration. The closure skirt 16 extends slightly radially outwardly from the top 14 forming an angle $\alpha$ which is preferably in the range of between about 1° and 5°. By this construction the annular channel 30 has an upwardly tapering configuration as seen in FIG. 2.

Due to the sloping configuration of the inner surface 14*a'* of top portion 14, as the closure 10 is screwed onto the neck 12, the inner edge of the neck top end surface 12*a'* makes initial engagement with an inner region of surface 14*a'* of top portion 14*a*. As the closure is further tightened onto the container neck, the extent of engagement between the top end surface 12*a'* and the inner surface 14-i a' of top portion 14*a* progressively increases in the radially outward direction. Referring to FIG. 4, the action described above has the effect that the top portion 14*a* and closure skirt 16 are pivotally deformed in the directions of arrows A and B, respectively. This deformation results in the engagement ring 26 being expanded, i.e., its outer diameter increases in the direction of arrow C. When the closure 10 has been completely tightened onto the container neck 12, the engagement ring 26 is expanded to an extent such that its outer sidewall 28 is in tight frictional engagement with the inner sidewall 32 of container neck 12*a* around its entire circumference.

In one test, it was noted that the engagement ring expanded in diameter about 0.020 inches. The inner diameter of the container neck is selected such that such expansion will cause the desired degree of engagement.

The engagement described above extends around the entire periphery of the container neck. As such, a hermetic or airtight seal is provided for the container between the inner and outer sidewalls 32 and 28 which seals the container contents from the ambient atmosphere.

The expansion of the engagement ring 26 is facilitated by non-planar configuration of the inner major portion of closure top 14 which has a convex dome-shaped configuration in the illustrated embodiment. Thus, the convex portion of top 14 has sufficient flexibility due to its configuration that the forces resisting the expansion of the engagement ring are absorbed by the top which is able to flex downwardly in the direction of arrow D (FIG. 4). This action has the two-fold advantage of reducing the effort required to produce the required deformation of the engagement ring while at the same time automatically creating an overpressure within the container due to the downward movement of the closure top 14.

The closure can be constructed such that the friction forces created between the inner and outer sidewalls 32 and 28 of the container neck 12*a* and the engagement ring 26 are sufficiently great that a child will not be able to exert an untwisting force which is large enough to remove the closure from the container neck. In this manner, the closure will also function as a safety closure.

More particularly, the resistance to untwisting presented by the frictional engagement of the sidewalls 28 and 32 may be sufficiently great that although an adult could effect untwisting of the closure from the container, a young child will not have enough strength to overcome the resistance. The particular dimensions of the engagement ring and container neck required for this operation can be determined by trial and error techniques. Moreover, the closure in its entirety or at least the engagement ring 26, and/or the container neck may be formed of a polymer, having a high coefficient of friction such as butadiene to increase the frictional forces resisting untwisting of the closure. Alternatively the outer sidewall 28 of engagement ring 26 and/or the inner sidewall 32 of container neck 12*a* can be coated with a material having a high coefficient of friction.

The inner sidewall 32 of the container neck 12*a* usually has a substantially circular transverse cross-section. However, it may be advantageous in certain circumstances to provide a non-circular configuration therefor. For example, referring to FIG. 4A, the inner sidewall 32 is formed with a cross-section having undulations forming longitudinal channels in the sidewalls 32. The closure or at least the engagement ring 26 thereof is formed of a relatively pliable polymer, such as a vinyl resin, which will flow into the channels of the sidewall 32 as shown in FIG. 4A upon engagement of the engagement ring 26 therewith. In this manner the friction forces resisting untwisting of the closure are aided by the positive mechanical forces created by the presence of the portions of the engagement ring 26 in the channels formed in the neck sidewall.

Although the engagement means in the embodiment of FIGS. 1–4 are illustrated in the form of a continuous engagement ring 26, it is understood that the engagement means can have other configurations within the scope of the invention. For example, a plurality of engagement fingers 34 (shown in phantom in FIG. 2) can be provided in lieu of the ring 26, each engagement finger 34 extending downwardly from the closure top and having an outer sidewall which is spaced radially inwardly from the opposed region of the inner sidewall of the closure skirt. When the closure is applied to the container, the fingers 34 will be deformed so as to expand radially outwardly until the outer sidewalls of the fingers tightly engage corresponding regions of the inner sidewall of the container neck. Of course, a hermetic seal will not be obtained in this case although the closure can be adapted to function as a safety closure.

Moreover, the principles of the invention as embodied in the closure of FIGS. 1–4 can be applied equally as well to a snap-type closure as will be readily understood by those skilled in the art and as described below in connection with certain other embodiments.

It is seen that the closure is extremely simple in design and construction and does not require any modifications to be made in the neck of the container. Since the hermetic seal and/or friction locking is achieved in an automatic manner as the closure is applied to the container, there is no need for additional manipulations to obtain the hermetic seal and/or friction locking.

Referring now to FIGS. 5–7, a closure 38 according to the present invention is illustrated which is somewhat similar in construction to the embodiment of the closure illustrated in FIGS. 1–4 so that the same numerals are used to designate corresponding features. The differences in construction and operation between the closure 38 and the closure 10 of FIGS. 1–4 are described below.

The closure 38 is provided with engagement means in the form of an engagement ring 40 formed integrally with and extending downwardly from the closure top 14. The engagement ring 40 of closure 38 extends downwardly from the top 14 to a lesser extent than the engagement ring 26 of closure 10 as clearly seen in the figures. However, like the engagement ring 26 of closure 10, the engagement ring 40 of closure 38 has an outer sidewall 42 which is spaced radially inwardly from the inner sidewall 18 of the closure skirt 16 at all points around its circumference to define an annular channel 30 in which the upper end region of the container neck 12*a* is received when the closure is applied thereto.

Like the embodiment of FIGS. 1–4, the configuration of the annular channel 30 provides the mechanism by which the engagement ring 40 is expanded radially outwardly during the application of the closure 38 to the container 12 to urge the outer sidewall 42 of the engagement ring 40 tightly into engagement with an upper region of the inner sidewall 32 of the container neck 12*a* continuously around its entire circumference to effect a tight hermetic seal and/or friction locking of the closure 38 to the container.

Thus, as the closure 38 is screwed onto the container neck 12*a*, the top portion 14*a* and closure skirt 16 are deformed in the direction of arrows A and B, respectively which results in the engagement ring 40 being expanded outwardly in the direction of arrow C. When the closure 38 has been completely tightened onto the container neck 12, the engagement ring 40 is expanded to an extent such that its outer sidewall 42 is in tight engagement with the inner sidewall 32 of container neck 12*a* around its entire circumference.

As in the embodiment of FIGS. 1–4, the expansion of the engagement ring 40 of closure 38 is facilitated by the convex configuration of the major portion of the closure top 14 which flexes in the direction of arrow D (FIG. 6) to reduce the effort required to produce the required deformation of the engagement ring and for possibly producing a desired overpressure within the container.

Moreover, according to the embodiment of FIGS. 5–7, the closure 38 is constructed such that when a downward force which is greater than a certain minimum force is applied to the convex or dome-shaped top 14, as designated by arrow F in FIG. 7, such as by the application of finger pressure, the top 14 will flex into a concave or depressed configuration as seen in FIG. 7. This flexure of the top 14 into a concave configuration causes the engagement ring 40 to rise to a position wherein the outer sidewall 42 thereof is disengaged from the inner sidewall 32 of the container neck 12*a* as seen in FIG. 7.

This construction is advantageous in several respects. The closure 38 is thus constructed so that when the closure is tightened onto the container as seen in FIG. 6, the engagement between the inner and outer sidewalls 32 and 42 of the container neck 12*a* and engagement ring 40 respectively is sufficiently tight to provide both a hermetic seal as well as a friction locking which normally could not be overcome, even by an adult. In order to effect an unlocking of the closure 38 from the container neck, it is necessary to apply a force greater than a certain minimum force to flex the closure top 14 to its concave position as seen in FIG. 7 whereupon the engagement ring is disengaged from the inner sidewall 32 of the container neck. The minimum force required to effect the flexure of the closure top into its concave position can be suitably adjusted, such as by providing a suitable thickness for the closure top, so that any adult will be capable of applying the necessary force to the closure top to effect disengagement of the engagement means, but so that a child will not be sufficiently strong to exert the necessary minimum disengaging force. Thus, the closure of FIGS. 5–7 will function both as a hermetic sealing closure as well as a safety or childproof closure.

Referring now to the embodiment of the invention illustrated in FIGS. 8 and 9, a closure 48 has substantially the same construction as closure 10 of FIGS. 1–4. However, the neck 12*a* of container 12 has been modified to even further increase the integrity of the hermetic seal and/or friction locking.

In particular, the upper end region 50 of container neck 12*a* is provided with a reduced thickness relative to the major portion of the container neck so as to define an upwardly facing shoulder 52 and an inner vertical sidewall 54. The dimensions of the upper end region 50 are selected so that when the closure 48 is tightened onto the container neck, the engagement ring 26 will tightly engage both the inner vertical sidewall 54 as well as the upwardly facing shoulder 52 to provide an extremely reliable hermetic seal and/or friction locking of the closure to the container.

Particularly, as the closure 48 is screwed onto the neck 12*a*, the engagement ring 26 is automatically expanded outwardly in the same manner as described above in connection with the embodiments of closures 10 and 38 so that the outer sidewall 28 of engagement ring 26 eventually tightly engages the vertical sidewall 54 of container neck 12*a*. Moreover, as the closure 48 is tightened over the container, the lowermost regions 56 of engagement ring 26 will also engage the upwardly facing shoulder 52. The engagement ring 26 is preferably designed so that when the closure 48 is completely tightened, the lowermost region 56 of the engagement ring 26 will be urged with sufficient force against the shoulder 52 so as to deform to enhance the sealing and/or friction locking of the closure on the container.

Figure 11:
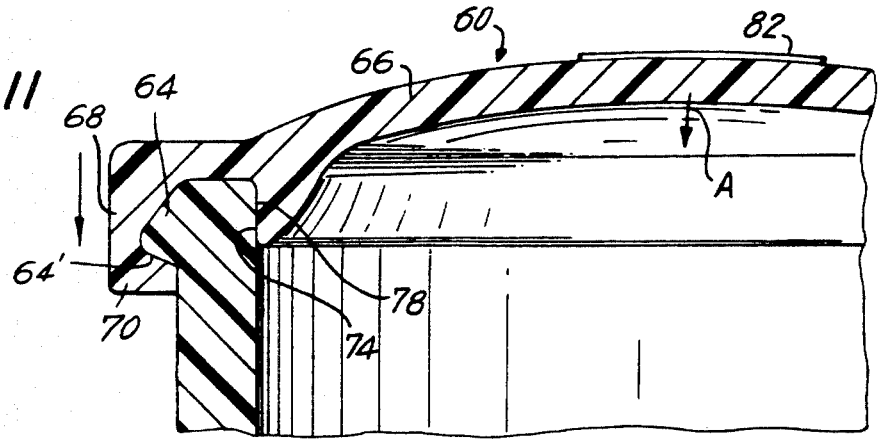
FIG. 11 is a view similar to FIG. 10 and illustrating the closure applied to the container neck.
Figure 12:
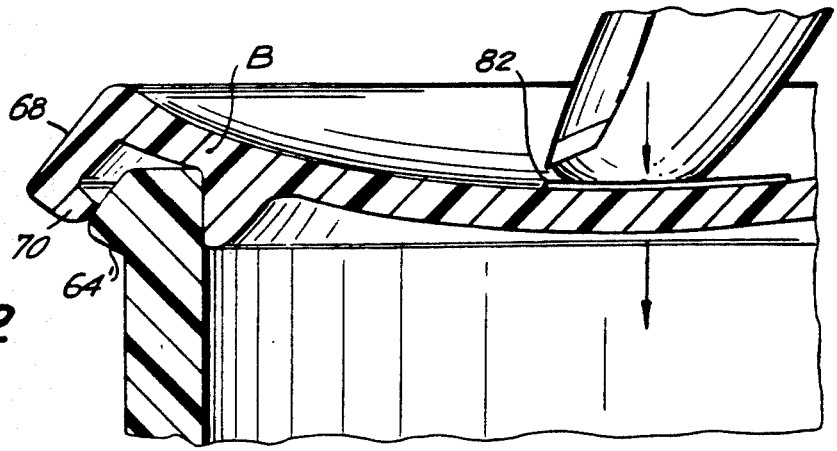
FIG. 12 is a view similar to FIGS. 10 and 11 and illustrating the removal of the closure from the container neck.

Referring now to FIGS. 10–12, another embodiment of a closure in accordance with the invention is illustrated wherein the closure is of the snap-type instead of being of the screw-type as in the case of the previously described embodiments.

The closure 60 is intended to close a container 62 whose neck has an outwardly extending bead or shoulder 64 adjacent its upper end. The closure 60 includes a closed top 66 and an integral peripheral skirt 68. The closure skirt is provided with an inwardly directed shoulder or flange 70 adapted to engage beneath the bead 64 formed on the container neck when the closure is applied to the container. Thus, the skirt 68 flexes outwardly when the closure is applied to the container whereupon the flange 70 snaps into engagement beneath the bead 64 to hold the closure on the container.

In accordance with the invention, the closure 60 is provided with engagement means in the form of an engagement ring 72 spaced radially inwardly from the inner sidewall of the closure skirt. The engagement ring 72 is formed integrally with and extends downwardly from the closure top 66 and has an outer sidewall 74 having portions which are spaced radially inwardly from the inner sidewall of the skirt to form a channel 76 in which the upper end region of the container neck is received when the closure is applied to the container.

As in the embodiments of FIGS. 2, 5 and 8, the mechanism by which the outer sidewall 74 of engagement ring 72 is brought into engagement with the inner sidewall 78 of the container neck to effect the friction locking and/or hermetic seal is constituted by the particular geometry of the annular channel 76. As seen in FIG. 10, the outer sidewall 74 of the engagement ring 72 slopes downwardly and inwardly while an upper region of the inner sidewall of skirt 68 slopes inwardly and upwardly. Due to this configuration, when the closure 60 is applied to the container 62 as described above, the closure in the regions of the channel 76 is deformed to an extent such that the outer sidewall 74 of engagement ring 72 is urged into tight frictional engagement with the inner sidewall 78 of the neck of container 62 as seen in FIG. 11. The expansion of the engagement ring 72 is facilitated by the configuration of the closure top 66 which has a normally convex, i.e., dome-shaped, configuration so that the forces resisting the expansion of the engagement ring are absorbed by the top 66 which flexes downwardly to some extent in the direction of arrow A (FIG. 11). As noted above in connection with the embodiment of FIG. 2, this has the two-fold advantage of reducing the effort required to produce the required expansion of the engagement ring while at the same time automatically creates an overpressure within the container due to the downward movement of the closure top 14.

The closure 60 becomes locked to the container 62 by virtue of the upper edge region of the container including the bead 64 being captured between the closure skirt 68, the inwardly extending flange 70 and the engagement ring 72 which tightly engages the inner sidewall 78 of the container.

As in the case of the embodiment of FIG. 5, removal of the closure 60 from the container 62 is accomplished by depressing the top 66 of the closure to its concave configuration as seen in FIG. 12. In particular, the closure 60 is constructed so that upon depressing the top 66, the peripheral edge region 80 of the closure top pivots upwardly around a point B (FIG. 12) thereby lifting the skirt 68. The bead 64 is preferably formed with a bottom surface 64' which slopes upwardly and outwardly so that the lifting of the peripheral skirt 68 causes the flange 70 to ride upwardly over the bead surface 64' whereupon the flange 70 eventually becomes disengaged from the bead 64.

The embodiment of the closure illustrated in FIGS. 10–12 is designed so as to provide a hermetic seal and/or a friction locking of the closure to the container. The engaging sidewalls of the engagement ring and container may be provided with a high friction coating as described above to facilitate a friction locking. The hermetic seal provided by the engagement of the sidewalls of the engagement ring and container neck allows an overpressure to be maintained within the container. Moreover, the closure top 66 can be constructed so that the force required to depress the top to its concave condition as seen in FIG. 12 is sufficiently great that a child will not be able to effect such depression so that the closure can be designed to function as a childproof or safety closure.

The closure 60 can be provided with a tamper-evidence feature of the type disclosed in applicants' U.S. Pat. No. 4,479,585 For example, a non-pliable, frangible substance, such as a thin film of lacquer 82 is applied to the upper surface of the closure top 66 before or.after the application of the closure 66 to the container as seen in FIG. 11. Upon the initial depression of the closure top 66 to effect removal of the closure from the container, the frangible film 82 will visibly fracture, split, crack, spider or separate from the closure top thereby providing a visual indication that the closure has at some time already been removed or at least unlocked from the container.

Figure 13:
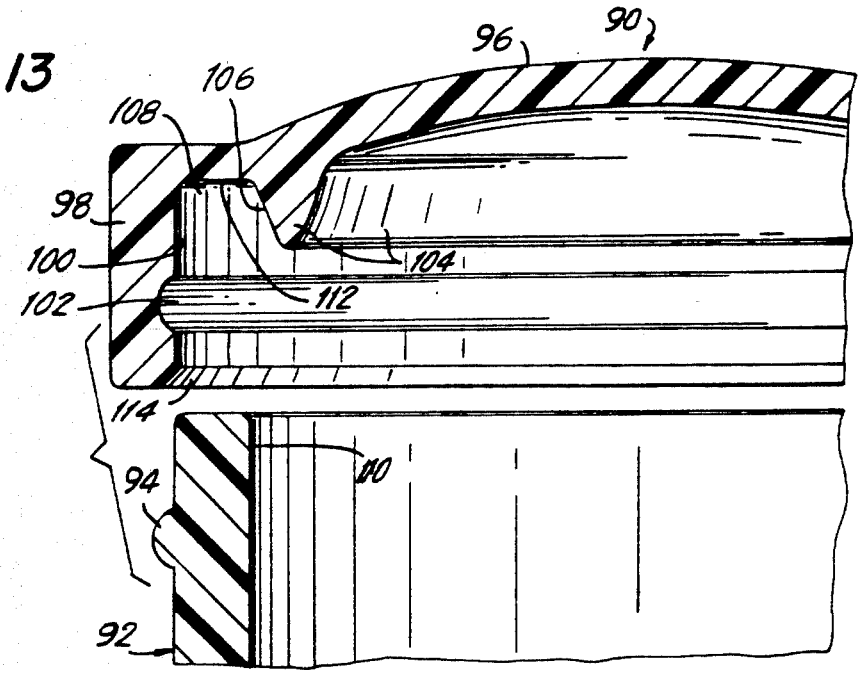
FIG. 13 is a partial side sectional view of a closure according to a fifth embodiment of the main form of the invention, and illustrating the closure prior to its application to the neck of a container also shown in the figure.
Figure 14:
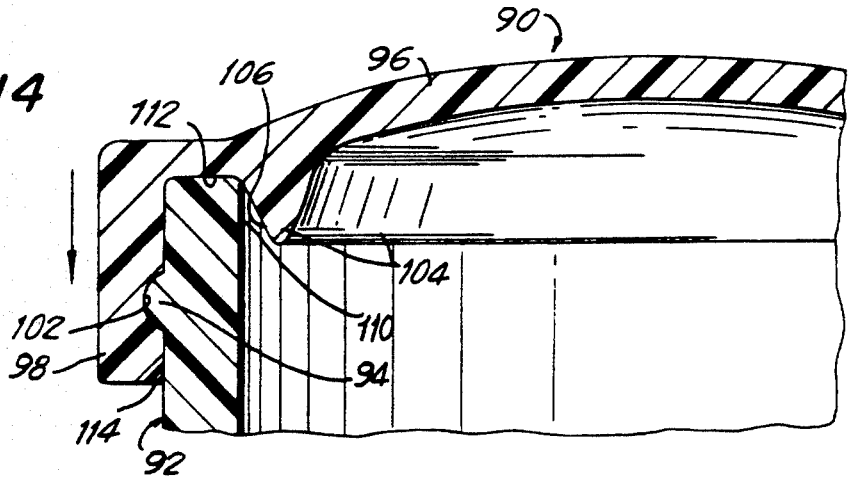
FIG. 14 is a view similar to FIG. 13 and showing the closure applied to the container neck and prior to effecting engagement of the engagement means of the closure to the container neck.
Figure 15:
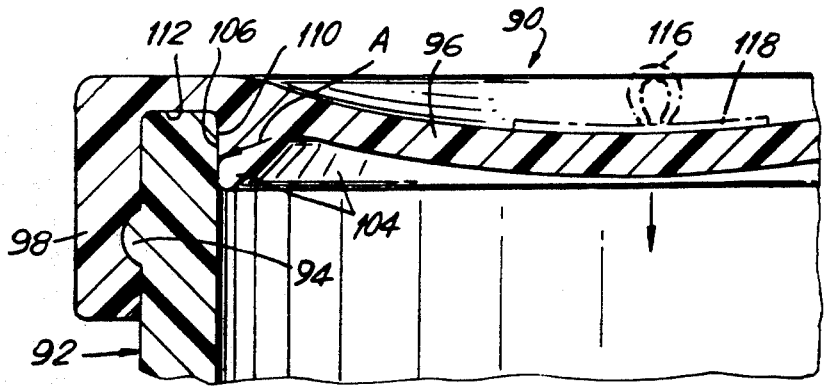
FIG. 15 is a view similar to FIGS. 13 and 14 and illustrating the closure subsequent to engagement of the closure engagement means with the container neck.

Referring now to the embodiment of the invention illustrated in FIGS. 13–15, a snap-type closure 90 is illustrated which is to be applied to a container 92 provided with a circumferentially extending bead 94. The closure 90 includes a dish-shaped closed top 96 and an integral peripheral skirt 98 having an inner sidewall 100 in which a circumferentially extending recess 102 is formed which is adapted to receive the bead 94 when the closure is applied to the container as seen in FIG. 14.

The closure 90 is provided with engagement means in the form of an engagement ring 104 which is integral with and extends downwardly from the closure top 96. The engagement ring 104 has an outer sidewall 106 which is spaced radially inwardly from the inner sidewall 100 of the skirt 98 to define an annular channel 108 in which the upper end region of the neck of container 92 is received when the closure 90 is applied thereto as best seen in FIG. 14.

Unlike the previously discussed embodiments, the closure 90 is provided with means for actuating the expansion of the sealing ring 104 after the closure has been applied to the container to urge the outer sidewall 106 of engagement ring 104 tightly into engagement with the inner sidewall 110 of the container neck continuously around its circumference to thereby obtain a hermetic sealing of the container and/or a friction locking of the closure to the container. In particular, it is seen that the sloped outer sidewall 106 of the engagement ring 104 is not engaged by the upper edge surface of the container neck when the closure is applied to the container. Rather, the inner wall 112 of the peripheral edge region of the closure top 96 has a substantially planar configuration whose width is preferably substantially the same as the thickness of the container neck so that when the closure is applied to the container as shown in FIG. 14, the outer sidewall 106 of the engagement ring 104 extends downwardly and inwardly away from the inner sidewall 110 of the container neck.

The closure 90 is constructed so that after it has been applied to the container 92, the dome-shaped top 96 can be depressed through the application of a suitable force thereto whereupon the engagement ring 104 expands outwardly in the direction of arrow A (FIG. 15) so that the outer sidewall 106 thereof tightly engages the inner sidewall 110 of the container neck. In this manner, a hermetic seal and/or friction locking of the closure to the container is accomplished. Indeed, this embodiment is especially advantageous in providing a pressurized hermetic seal for certain types of foods, such as beverages, since a relatively substantial overpressure is created within the container when the closure top is depressed into its concave configuration. Since the hermetic seal is formed simultaneously with the expansion of the engagement ring into engagement with the container neck, the overpressure will be maintained.

In order to remove the closure 90 from the container 92, an undercut 114 is formed at the lower edge of the skirt 98 which can be grasped by a finger whereupon the closure can be pulled from the container. However, the closure can be constructed in a manner such that it is necessary to actuate the container top 96 back to its concave configuration to disengage the sidewalls 106 and 110 before the closure can be removed. In this case, a handle 116 may be integrally formed on the closure top 96. When it is desired to remove the closure from the container, the handle 116 is grasped whereupon the top 96 is actuated from its concave configuration of FIG. 15 to its convex configuration of FIG. 14.

A tamper-evident film 118 can be applied to the closure top 96 after the closure has been applied to the container for the first time as seen in FIG. 15. In the case where it is necessary to actuate the closure top to its convex configuration in order to effect removal of the closure from the container, such actuation will cause the frangible coating to fracture, spider or separate from the closure top to evidence an initial removal, or at least unlocking, of the closure.

It will be understood that the principles of the invention incorporated in the embodiment of FIGS. 13–15 can be used equally as well in a closure of the threaded type, i.e., is not limited to a snap-type closure. In such case, the closure is screwed tightly on to the container whereupon the closure top is actuated to its concave configuration to thereby expand the engagement ring 104 to bring the sidewalls 106 and 110 into tight engagement.

Figure 16:
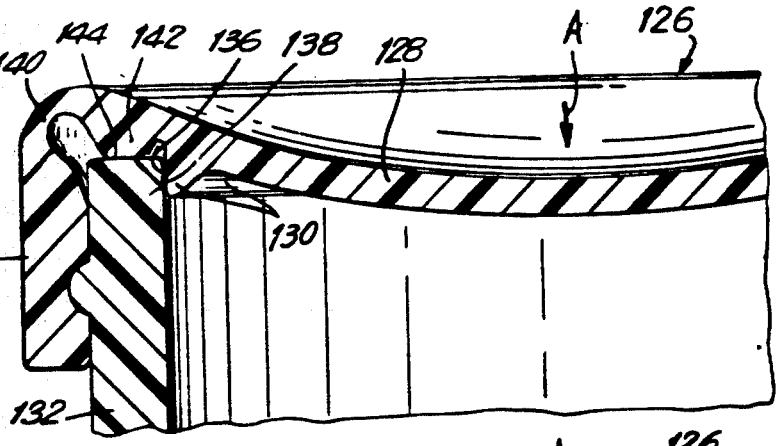
FIG. 16 is a partial side sectional view of a closure according to a sixth embodiment of the main form of the present invention and illustrating the closure applied to the container neck and with its engagement means engaging the neck of the container.
Figure 17:
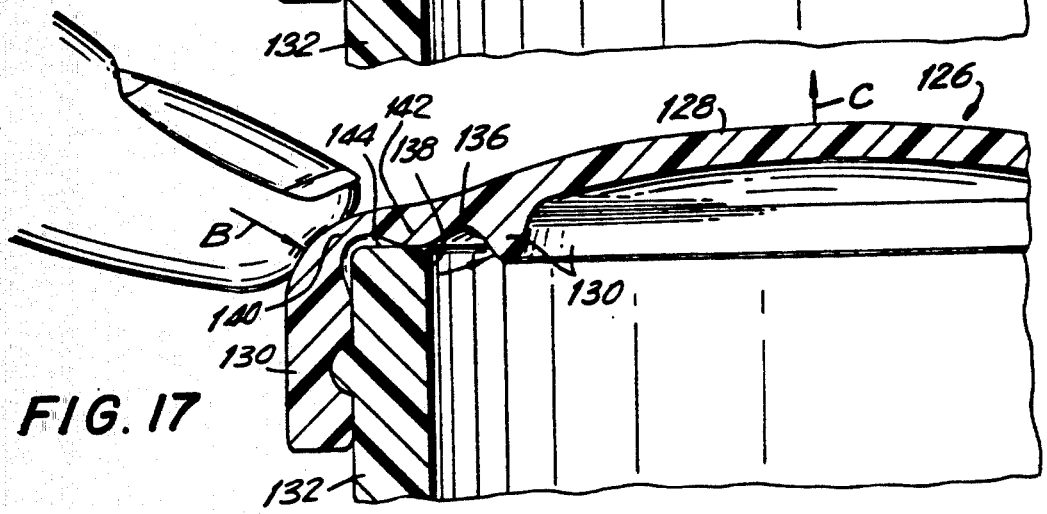
FIG. 17 is a view similar to FIG. 16 and illustrating the disengagement of the engagement means of the closure from the container neck.

A closure 126 in accordance with another embodiment of the invention is illustrated in FIGS. 16 and 17. Closure 126 is similar to closure 90 of FIGS. 13–15 in that the same constitutes a snap-type closure which is first applied to a container whereupon actuating means in the form of a non-planar top of the closure are actuated to expand the engagement means to obtain a tight engagement with the inner sidewall of the container neck to effect a hermetic seal and/or a friction locking of the closure to the container. Thus, the expansion of the engagement means is effected subsequent to the application of the closure to the container.

More particularly, referring to FIG. 17, the closure 126 includes a closed top 128 and an integral peripheral skirt 130 having a circumferential channel formed in its inner sidewall which receives a circumferential bead formed on the outer sidewall of the container neck when the closure is applied to the container in the same manner as described above in connection with the embodiment of FIGS. 13–15.

Engagement means in the form of an engagement ring 130 are integral with and extend downwardly from the closure top 128.

The closure 126 is shown as a snap-type closure adapted to be applied to a container 132 in the condition shown in FIG. 17, i.e., with its top 128 having a dome-shaped or convex configuration. The peripheral skirt 130 has a circumferential recess formed in its inner sidewall which is adapted to receive a circumferential bead extending around the upper region of the container 132. The closure 126 is functionally similar to the closure 90 of FIGS. 13–15 in that the engagement ring 130 is expanded so that its outer sidewall 136 tightly engages the inner sidewall 138 of the container 132 after the closure has been applied to the container through the depression of the closure top 128 to its concave configuration as seen in FIG. 16. However, disengagement of the sidewalls 136 and 138 is effected in a different manner, namely, through the application of pressure on the periphery of the closure to "snap" the closure top back to its convex configuration.

Referring to FIG. 17, the closure 126 is formed with a thinned peripheral region 140 at which the skirt 130 joins with the top 128. A downwardly extending ring-shaped rib 142 is formed at the outer periphery of the closure top 128 in a position such that upon application of the closure to the container the rib 142 engages the top edge surface 144 of the container 132 as seen in FIG. 17. Thus, when the closure 126 is initially applied to container 132, the configuration illustrated in FIG. 17 is obtained with the rib 142 engaging the top edge surface 144 of the container and with the outer sidewall 136 of engagement ring 130 spaced inwardly from the inner sidewall 138 of the container 132.

In order to effect a reliable hermetic seal and/or a friction locking of the closure to the container, the closure top 128 is depressed in the direction of arrow A of FIG. 16 until the closure snaps into its concave configuration. Like the embodiment of FIGS. 13–15, the closure is constructed so that the top will flex between two stable positions, namely the concave and convex positions of FIGS. 16 and 17, with an overcenter or toggle type of action as will be readily understood by those skilled in the art. Depression of the top 128 to its concave configuration results in an expansion of the engagement ring 130 so that the outer sidewall 136 thereof tightly engages the inner sidewall 138 of container 132. Moreover, as seen in FIG. 16, the thinned peripheral region 140 of the closure is deformed to the position shown in FIG. 16 while the ring-shaped rib 142 rides outwardly on the top edge surface 144 of container 132.

In order to effect disengagement of the sidewalls of the engagement ring 130 and container 132, an inward palm or finger pressure is applied to the thinned peripheral region 140 as designated by arrow B in FIG. 17. This pressure causes the closure top 128 to snap back to its convex or dome-shaped configuration as designated by arrow C in FIG. 17 whereupon the engagement ring retracts back to its original position.

This embodiment of the invention is particularly advantageous for use in connection with closing containers for beverages in that the depression of the closure top 128 to its concave configuration simultaneously results in a hermetic seal being formed by engagement of the sidewalls of the engagement ring and container together with the creation of an overpressure within the container. Moreover, the closure can easily be constructed so that a certain minimum pressure B is required to effect the return of the closure top back to its original position with consequent disengagement of the engagement ring from the container. It will again be understood that although the closure 126 is illustrated as a snap-type closure, the principles of the invention utilized in this embodiment may be applied to a screw-type closure.

Referring now to FIGS. 18 and 19, a closure 150 is illustrated which is adapted to be locked onto a container and which may provide an enhanced hermetic seal and/or safety or child-resistant features. The closure 150 includes a normally convex top 152 and a peripherally extending skirt 154 which terminates at its lower edge with an inwardly directed flange 156 which snaps under a side rim 158 of the container 160 when the closure is applied thereto. The skirt is joined to the closure top at a peripheral region or rim 162 which is formed so as to be spaced outwardly from the opposed region of the container as seen in FIG. 18.

The container 160 differs from the containers used with the closures of the previously described embodiments in that an inwardly extending lip 164 is formed at its upper end. The lip 164 is engaged by engagement means of the closure to effect a locking of the closure to the container as described below and/or to enhance a hermetic seal which is formed with the closure is applied. The closure is provided with engagement means in the form of a ring-shaped flange 166 integrally formed with and extending downwardly from the closure top 152 at a position spaced inwardly from the closure skirt 154. An upwardly facing shoulder 168 is formed in the outer surface of flange 166.

In operation, the closure 150 is applied to container 160 so that the flange 156 snaps under the side rim 158 of the container to secure the closure to the container and provide resistance to removal of the closure therefrom. As seen in FIG. 18, when the closure is initially applied to the container, the flange 166 extends downwardly and inwardly in a position so as not to engage the container lip 164. After the closure has been applied to the container as described above, the closure top 152 is depressed until it snaps into its concave configuration as seen in FIG. 19. Thus, the closure 150 is constructed so that the top 152 has an over-center or toggle action as in the case of the embodiments of closures 90 and 126. The depression of closure top 152 causes the flange 166 to expand outwardly whereupon the shoulder 168 formed in flange 166 engages the undersurface of the lip 164 of container 160 as seen in FIG. 19 thereby positively locking the closure to the container. It is noted that unlike the previously described embodiments, the locking of the closure 150 to container 160 is not a friction locking but, rather, constitutes a positive locking obtained by engagement of the shoulder 168 with the lip 164.

The mechanism by which the flange 166 is disengaged from the lip 164 is similar to that described above in connection with the embodiment of FIGS. 16 and 17. In particular, in order to effect disengagement, an inwardly directed pressure is applied to the peripheral region of 162 of the closure as designated by arrow A in FIG. 19. This inward peripheral pressure causes the closure top 152 to snap back into its convex cinfiguration with the flange 166 consequently retracting radially inwardly back to its original position as seen in FIG. 18. The closure 150 may have a child-resistant feature by providing that the peripheral pressure required to effect the snapping of the dome back to its original convex position be greater than a certain minimum pressure. As in the case of the embodiments of FIGS. 13 and 16, closure 150 is particularly advantageous in applications where an overpressure is desired to be created within the container since depression of the closure top 152 to effect locking of the closure to the container will at the same time create an overpressure within the container.

Figure 20:
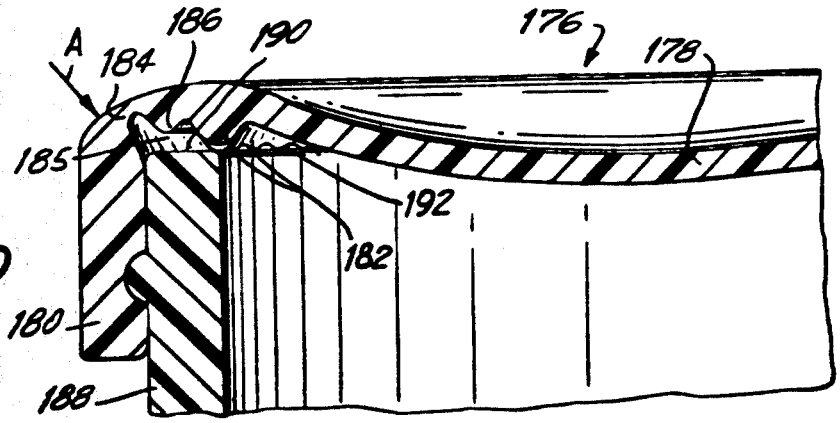
FIG. 20 is a partial side sectional view of a closure according to an eighth embodiment of the main form of the present invention and illustrating the closure subsequent to its being applied to the container neck and prior to the engagement of the engagement means with the container neck.
Figure 21:
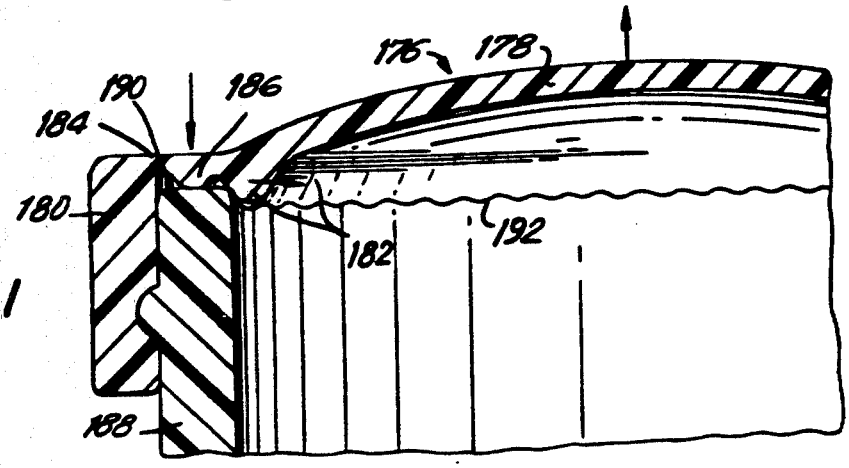
FIG. 21 is a view similar to FIG. 20 and illustrating the closure subsequent to engagement of the engagement means with the container neck.

Referring now to FIGS. 20 and 21, another embodiment of a closure in accordance with the invention is illustrated which is particularly adapted for use in sealing containers whose contents are preferably to be maintained at an under pressure or partial vacuum.

Closure 176 includes a normally concave or dish-shaped top 178 and a peripheral skirt 180. Engagement means in the form of an engagement ring 182 extend downwardly from top 178 and a thinned peripheral region or rim 184 is provided where the skirt 180 joins the top 178. A ring-shaped rib 186 protrudes downwardly from the closure top 178 between the engagement ring 182 and the peripheral rim 184. The closure 176 is a snap-type closure with a circumferential recess being formed in the inner sidewall of skirt 180 which receives a corresponding circumferential bead formed on the outer sidewall of the container 188 when the closure is applied to the container. The rib 186 is formed so as to be spaced upwardly from the top edge surface 190.

Unlike the previously described embodiments, the lower regions of the engagement ring 182 are scalloped as at 192 and, moreover, the engagement ring 182 is situated so as to engage the top edge surface 190 of container 188 upon the closure 176 being initially applied to the container 188. It is also to be noted that the region of the closure extending between the peripheral region or rim 184 and the engagement ring 182 bows somewhat upwardly after the initial application of the closure to the container as seen in FIG. 20.

A secure hermetic seal is obtained by exerting an inward pressure in the region of the thinned peripheral region 184 of the closure as designated by arrow A in FIG. 20. In this manner the engagement ring 182 is caused to ride inwardly over the top edge surface 190 of the container whereupon the closure top 178 snaps into its convex or dome-shaped configuration as seen in FIG. 21. At the same time, the rib 186 moves into engagement with the top edge surface 190 of the container. As seen in FIG. 21, the inner sidewall of engagement ring 182 sealingly engages the inner sidewall of container 188 when the top 178 attains its elevated or convex configuration. Since the hermetic seal is formed simultaneously with the movement of the closure top to its elevated configuration, an underpressure or partial vacuum is created in the container. The closure is constructed to assure that the partial vacuum existing in the container will not cause the container top to be drawn back into its dish-shaped or concave configuration.

In order to break the seal, the top, which is in its elevated condition, is depressed which causes the engagement ring 182 to ride upwardly over the inner sidewall of container 188 to return to its original position shown in FIG. 20. In this connection, a space created between the thinned peripheral region or rim 184 of closure 176 and the container 188 functions as an air reservoir 185. As the engagement ring rises with depression of the closure top, the scalloped surface 192 of the engagement ring forms a series of vent-like passages through which the air contained in the air reservoir enters into the container to facilitate the breaking of the seal and removal of the closure from the container.

Turning now to FIGS. 22–29, a closure 200 in accordance with another main form of the invention is illustrated. Unlike the closures of the previously described embodiments, closure 200 is specifically adapted for use as a screw-type closure. Moreover, unlike the previously described closures, closure 200 comprises a safety or childproof closure wherein locking of the closure to the container is effected through an engagement of the closure with the outer sidewall of the container.

Referring to FIGS. 22–24, the closure 200 includes a normally convex or dome-shaped top 202 and a peripherally extending skirt 204. A sealing ring or bead 206 extends downwardly from the peripheral region of top 202 and a ring-shaped lockout member 208 defining a pair of shoulders 210 and 212 extends downwardly from the closure top in the region between the sealing ring 206 and the skirt 204 for purposes which will be made clear below.

The skirt 204 of closure 200 includes an upper friction portion 214, a lower internally threaded portion 216 and an intermediate portion 218 constituted by a relatively thin web integrally connecting the upper and lower portions 214 and 216.

The inner sidewall 220 of the upper friction portion 214 of skirt 204 is provided with friction means which are adapted to engage the outer sidewall of the container as the closure is screwed onto the container. In the illustrated embodiment, the friction means are constituted by a plurality of teeth or serrations 222 which extend from the inner sidewall 220 in a direction substantially opposite to the clockwise direction in which the closure is screwed onto the container. The orientation of the teeth or serrations 222 is best seen in FIG. 24. Internal threads 224 are formed in the inner sidewall of the lower threaded portion 216 of closure skirt 204 (FIG. 23).

The teeth or serrations 222 are preferably integrally formed with closure 200 although it is understood that a separate ring-type insert may be affixed to the inner sidewall 222 of the friction portion 214 of skirt 204. Although the teeth or serrations 222 may be formed of the same material as that of which the closure is formed, it is preferable that the teeth or at least portions thereof be formed of or coated with a material having a high coefficient of friction. Thus, it is preferred that at least the surfaces 226 (FIG. 24) of teeth 222 be provided with a coating of a material having a high coefficient of friction.

Referring now to FIGS. 25–29, the closure is applied to the neck 228 of a container 230 which is provided with standard male threads 232. As the closure 200 is screwed in a clockwise direction (as viewed from the top) onto the closure, the teeth or serrations 222 constituting the friction means of the closure eventually come into rubbing contact with the uppermost or friction region 234 of the outer sidewall of the container neck 228. Although this region of the container neck may be formed of the same material of which the container in its entirety is formed, it is preferred that the region 234 be provided with a coating of material having a high coefficient of friction.

Figure 26:
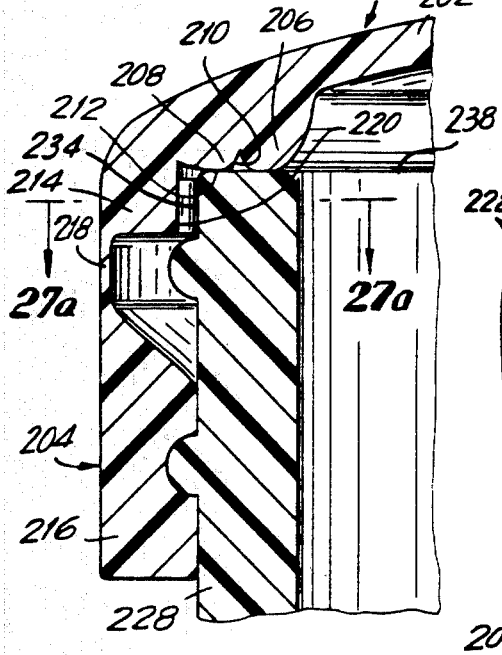
FIG. 26 is a section view taken along line 26—26 of FIG. 25.
Figure 27A:
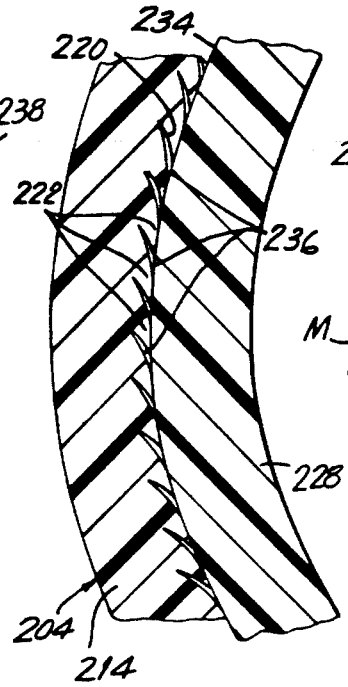
FIG. 27*a* is a section view taken along line 27*a*—27*a* of FIG. 26 and illustrating the closure applied and locked to the container neck.
Figure 27B:
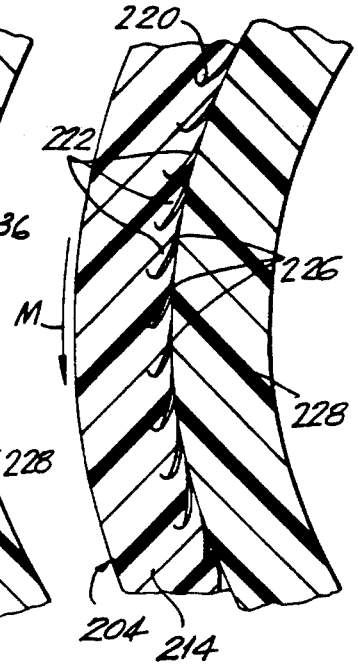
FIG. 27*b* is a view similar to FIG. 27*a* and illustrating the closure during an attempt to remove the same from the container neck.

Thus, as the closure 200 is screwed onto the container neck, the forward surfaces 236 of the teeth 222 engage the friction region 234 of the container neck. However, due to the particular orientation of the teeth or serrations 222 as described above, the teeth will yieldingly deform to obtain a configuration best seen in FIG. 27*a*. In this manner, although some resistance to the clockwise twisting of the closure onto the container will be presented by the engagement of the teeth 222 with the friction region 234 of the container neck, the twisting of the closure can be completed to a point where the closure is tightly associated with the container with the sealing ring 206 sealingly engaging the top edge surface 238 of the container neck as seen in FIG. 26. At the same time the shoulder 212 of the lockout member 208 at least lightly engages the top edge surface 238 of the container.

However, the engagement of the teeth or serrations 222 with the friction region 234 of the outer sidewall of the container neck effectively prevents the closure from being untwisted in a counter-clockwise direction thereby preventing removal of the closure from the container. More particularly, referring to FIG. 27*b*, when a counter-clockwise or untwisting moment, designated M, is applied to the closure, the latter will tend to twist to a slight degree until the teeth 222 flex or flip into a configuration shown in FIG. 27*b* whereupon the friction surfaces 226 of teeth 222 engage the friction region 234 of the container neck. In their flexed or flipped configurations, not only do the respective friction surfaces 226 and 234 engage each other but, additionally, the force of engagement is greater than that which is present during the twisting-on operation due to the fact that the teeth 222 inherently tend to return to their normal configurations. The combination of the engagement of the two friction surfaces having high coefficients of friction with the higher engagement forces between the surfaces results in an untwisting of the closure being prevented.

Figure 28:
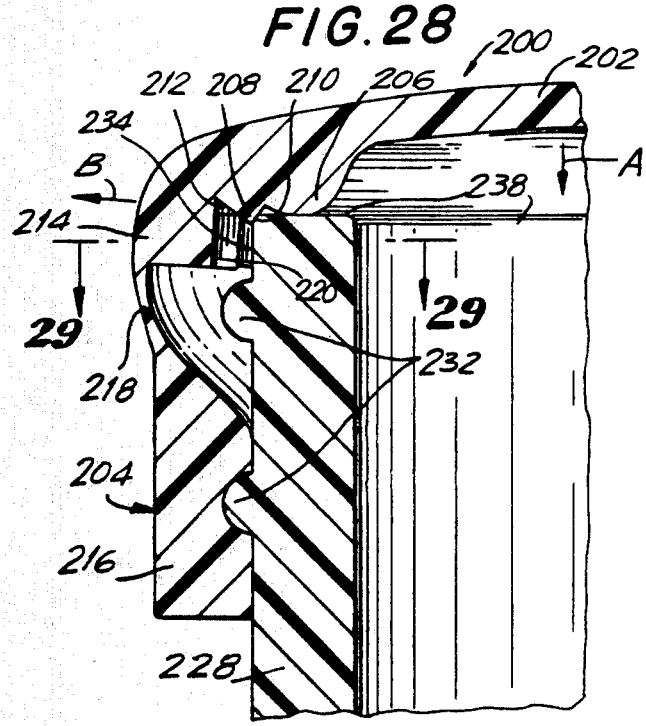
FIG. 28 is a section view similar to FIG. 26 and illustrating the unlocking of the closure from the container neck.
Figure 29:
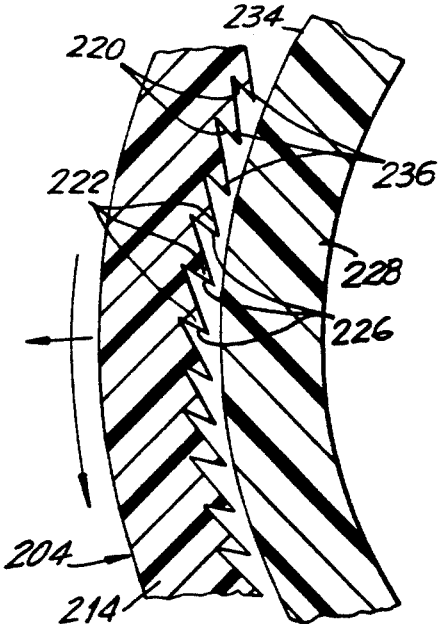
FIG. 29 is a section view taken along line 29—29 of FIG. 28.

When it is desired to unlock the closure 200 from the container 230, a downward pressure is applied to the closure top 202 to cause the same to flex downwardly as designated by arrow A in FIG. 28. The downward depression of the closure top 202 in turn causes the upper friction portion 214 of closure skirt 204 to expand radially outwardly as designated by arrow B in FIG. 28. This outward expansion is possible in view of the web-like structure of the intermediate skirt portion 218 which can thereby stretch to the extent necessary to allow for such outward expansion. The outward expansion of the friction portion 214 of skirt 204 results in the disengagement of the teeth or serrations 222 from the friction region 234 of the outer sidewall of the container neck as seen in FIG. 29. Moreover, depression of the closure top 202 causes the lockout member 208 to move radially outwardly as it rides over the top edge surface 238 of the container neck until the shoulder 210 engages the upper outer edge of the container neck. The engagement of shoulder 210 of lockout member 208 with the outer edge of the container effectively locks the friction portion 214 of skirt 204 in its outer or disengaged position and thereby permits the closure to be twisted in a counter-clockwise direction to effect removal of the closure from the container. As the closure is untwisted, the shoulder 210 eventually is disengaged from the container. However, by this time the upper friction portion of the closure skirt has reached a position where it is displaced from the friction region of the container so that the teeth or serrations 222 will not engage the container when the upper friction portion 214 of the skirt returns to its original position.

By suitably adjusting the thickness of the closure top in relationship to the configuration of the closure, the force required to effect the radial expansion of the upper friction portion 214 of the closure skirt 204 to the extent required to effect disengagement as described above can be suitably adjusted to require a certain minimum force. Such minimum force should be sufficiently low that an adult can effect the necessary top depression but sufficiently high so that a child could not effect such disengagement. In this manner, the closure 200 will provide an effective childproof or safety closure.

It will be understood that the friction means of the embodiment described above can be other than the serrations or teeth described in the preferred embodiment. Moreover, other modifications of the closure, such as the use of the threads on the container to effect the lockout of the upper friction portion of the skirt in lieu of the lockout member 208, are within the scope of the invention.

Referring to FIG. 30, another embodiment of a closure is illustrated of the type disclosed in embodiments of applications of which this application is a continuation-in-part. Thus, the closure 244 incorporates a locking tab 246 which is adapted to be moved from a locking position shown in FIG. 30 wherein it engages a locking surface provided on the outer surface of the container 248 to prevent untwisting of the closure from the container, to an unlocking position wherein the locking tab is pivotted radially outwardly through depression of the convex or dome-shaped top 250 thereof. In accordance with the embodiment of FIG. 30, the closure includes a peripheral skirt 252 which is joined to the top 250 by a thin web 254, the web 254 also being integrally connected to the locking tab 246 as shown. Movement of the locking tab 246 between its locking position and its radially outward unlocking position is permitted through a flexure of the thin web 254. This configuration of the closure is advantageous from the viewpoint of its construction in that the configuration does not present any undercuts when in its unlocking position thereby simplifying the molding apparatus required for its construction.

Referring now to FIG. 31, a closure construction is illustrated wherein the closure is provided with a closed top 256 comprising a central convex or dome-shaped portion 258 and a substantially planar peripheral portion 260. Engagement means in the form of an engagement ring 262 extends downwardly from the peripheral portion 260 of the closure top 256. The engagement ring 262 forms an annular space with the inner sidewall of the peripheral skirt 264 of the closure in which the upper region of the container neck 266 is received upon the closure being applied to the container. The engagement ring 262 is situated so that upon positioning the closure over the top of the container neck, it is necessary to apply a pressure to the peripheral portion 260 of the container top so that the upper region of the container neck is received in the space between the engagement ring 262 and the peripheral skirt 264 and so that the outer sidewall of the engagement ring rightly bears against the inner sidewall of the container neck to thereby effect a seal.

In order to effect an unsealing of the closure from the container, the central dome portion 258 of the closure top is depressed. By virtue of the particular construction of the closure of FIG. 31, depression of the central dome portion 258 of the closure top 256 results in a pivoting action of the peripheral top portion 260 with respect to a pivot point or line A which is situated inwardly of the inner sidewall of the container neck. Such pivoting motion results in a lifting of the engagement ring 262 from the inner sidewall of the container neck.

The embodiment of the closure shown in FIG. 31 illustrates the fact that the action caused by depression of a convex or dome-shaped top can be varied as desired by shifting the so-called pivot point or line. Thus, whereas in certain ones of the previously described embodiments the pivot point or line was situated vertically over the top edge surface of the container neck to result in the actions described in connection therewith, the shifting of the pivot region, such as to a position inwardly of the container neck results in yet another type of action which can be advantageously incorporated in a closure according to the present invention.

Referring now to FIGS. 32–34, a closure in accordance with the invention and in particular a closure which requires depression of a convex dome-shaped top to effect unlocking thereof from the container in accordance with the invention, is illustrated, the closure being provided with tamper-evident features as described below.

In one embodiment illustrated in FIGS. 32 and 33, a very thin web or membrane 272 is formed during the molding of the closure so as to extend from the peripheral rim 274 of the closure at one end to a region of the closure top 276 as best seen in FIG. 33. It will be readily understood that when the closure top 276 is depressed for the first time to effect unlocking or removal of the closure from its associated container, the thin membrane 272 will rupture or tear thereby providing a readily visible indication that the closure has at one time already been removed or at least unlocked from the container.

Alternatively, and preferably in the case where the dome-shaped top 276 of the closure has a central flat region 278, a thin rib 280 is integrally molded on the closure top extending substantially radially from an outer region of the top to a region situated on the flat 278. It will be readily understood that upon the initial depression of the closure top 276 to effect unlocking and removal of the closure from the container, the rib 280 will fracture or break thereby providing a visual indication of the initial depression of the closure top. Thus, it will be understood that closures constructed in accordance with the invention, such as wherein a dome-shaped top must change its configuration to effect removal of the closure, tamper-evident features may be integrally molded in the closure itself. Clearly, the tamper-evident features are not limited to the particular preferred embodiments described above and may take other forms, such as thin membranes extending between any two regions of the closure which are flexed with respect to each other to effect removal of the closure wherein the membrane will rupture or tear upon such flexure.

Referring to FIGS. 35 and 36, another embodiment of the form of the invention illustrated in FIGS. 22–29 is shown. The embodiment of FIGS. 35 and 36 differs from that of FIGS. 22–29 in that the locking means is constituted by a ratchet-pawl mechanism rather than a friction locking means.

The closure construction is essentially the same as that of FIGS. 22–29 and corresponding elements are designated by the same reference numerals, primed.

In the embodiment of FIGS. 35 and 36, the upper portion 214' of the closure skirt 204' has an inner sidewall 220' on which a plurality of ratchet teeth 300 are formed. The ratchet teeth 300 have forward edges 302 which are oblique, i.e., slanted rearwardly with respect to the closing or clockwise direction, designated by arrow A in FIG. 35. A pawl member 304 projects from the outer sidewall 234' of the container neck 228'. The rearward edges 306 of the ratchet teeth 300 extend substantially radially as seen in the figures.

Unlike the embodiment of FIGS. 22–29, the teeth 300 are somewhat spaced from the outer sidewall 234' of the container neck 228' as the closure is twisted in the direction A onto the container. The pawl member 304, however, engages the ratchet teeth as seen in FIG. 35 during the application of the closure to the container. However, as the teeth 300 engage the pawl member 304, the latter flexes as shown in FIG. 35 through engagement with the slanted surfaces 302 of the teeth 300 thereby permitting the closure to be completely twisted onto the container. However, when it is attempted to untwist the container in the opposite direction B (36), the pawl member 304 engages the radial rearward edge 306 of one of the teeth 302 (FIG. 36) and by virtue of this engagement it is not possible to untwist the closure from the container. Thus, engagement of the pawl member 304 with a radial surface 306 of one of the ratchet teeth 300 is such that the pawl member 304 cannot flex to the extent which would be required to allow the closure to be twisted in the direction B thereby effectively locking the closure to the container.

When it is desired to remove the closure from the container, the dome-shaped top 202 of the closure is depressed such as seen in FIG. 28 whereupon the upper locking portion 214' of the closure skirt 204' is expanded radially outwardly in the direction of arrow C (FIG. 36) whereupon the teeth 302 are moved a distance which is sufficient to disengage the radial teeth edges 306 from the pawl member 304 thereby allowing the closure to be untwisted from the container. A lockout member similar to lockout member 208 is preferably provided in the embodiment of FIGS. 35 and 36.

It is therefore seen that the form of the invention illustrated in FIGS. 22–29 can include other locking means than friction locking means. It will be understood that positive engagement means other than the type illustrated in FIGS. 35 and 36 can be utilized within the scope of the invention.

Referring now to FIGS. 37 and 38, still another embodiment of a closure in accordance with the invention is illustrated. Unlike all of the previously described embodiments, the closure 310 is not unitary but, rather, is formed of a main top portion 312 and an inner threaded portion 314.

The inner threaded portion 314 comprises a substantially cylindrical member having female threads 316 formed in its inner sidewall and a circumferential bead 318 formed on its outer sidewall.

Referring to FIG. 38, the main top portion 312 includes a closed top 320 having a normally convex, deformable configuration and a peripherally extending skirt 322 depending downwardly therefrom. Engagement means in the form of an engagement ring 324 extends downwardly from the closure top spaced a distance inwardly from the inner sidewall of the closure skirt 322. A circumferentially extending channel 326 is formed in the inner sidewall of the skirt 322 of the main top portion 312.

The inner threaded portion 314 is fitted in association with the main top portion 312 by urging the threaded portion 315 into the position shown in FIG. 38 with the bead 318 being loosely received within the channel 326 with the upper region of the inner threaded portion 314 being received within the space defined between the engagement ring 324 and the inner sidewall of the skirt 322. In the configuration shown in FIG. 38, the inner threaded portion 314 is rotatable with respect to the main top portion 312.

The convex top 320 is constructed so as to provide an over-center or toggle type action so that when sufficient pressure is exerted against the top, the latter will flex into a stable concave configuration as seen in FIG. 37. As in the case of certain of the embodiments described hereinabove, depression of the top 320 to its concave configuration results in a radially outward expansion of the engagement ring 324 whereupon the outer sidewall thereof tightly engages the inner sidewall of the inner threaded portion 314 thereby locking the threaded portion 314 to the main top portion 312, i.e., when the top 320 is depressed to its concave configuration, the inner threaded portion 314 of the closure 310 is no longer freely rotatable with respect to the main top portion 312. In order to provide a secure interengagement of the main top portion 312 and the inner threaded portion 314, the inner sidewall of the latter can be formed with channels of the type illustrated in FIG. 4A.

In operation, the closure is threadedly applied to the container 328 in the configuration illustrated in FIG. 37, i.e., with the engagement ring 324 tightly engaging the inner sidewall of the threaded insert 314 so that the main top portion 312 and inner threaded portion 314 are locked to each other. It will be understood that twisting of the main top portion 312 will thus cause a corresponding twisting of the inner threaded portion 314 whereupon the closure 310 can be tightly applied to the container 328.

When the closure 310 has been fully threaded onto the container, the top 320 is actuated to its convex configuration illustrated in FIG. 38, such as by pulling upwardly on a handle 330. When the closure top 320 obtains its convex configuration, the engagement ring 324 is retracted radially inwardly as seen in FIG. 38 whereupon the inner threaded portion 314 becomes freely rotatable with respect to the main top portion 312. It will be understood that in this configuration when the main top portion 312 is rotated, the inner threaded portion 314 will remain stationary since the loose engagement of the bead 318 in the channel 326 will allow the main top portion 312 to rotate with respect thereto. Accordingly, when the closure 310 is in the configuration illustrated in FIG. 38, it is effectively locked to the container. When it is desired to remove the closure from the container, it is only necessary to depress the closure top 320 to its concave configuration illustrated in FIG. 37 whereupon rotation of the main top portion 312 will result in a corresponding rotation of the inner threaded portion 314 to allow removal of the closure from the container.

Obviously, numerous modifications and variations are possible in the light of the above teachings. It is therefore to be understood that within the scope of the claims appended hereto, the invention may be practiced otherwise than as specifically disclosed herein.

What is claimed is:

1. In a closure adapted to be applied to an open end region of a container having a top wall and outer and inner sidewalls to close the same, the closure including a top and an integral skirt depending from a peripheral edge region of said top, said skirt having an inner sidewall adapted to fit over the outer sidewall of the container, the improvement comprising:

inner engagement sealing means integral with and extending from said closure top, said engagement sealing means having an outer sealing surface portion spaced radially inwardly from said skirt inner sidewall to at least partially define a space therebetween for receiving at least a portion of the open end region of the container;

means for outwardly expanding said engagement sealing means during application of the closure to the container to urge said outer sealing surface portion thereof against the inner sidewall of the open end region of the container, said expanding means including a central non-planar region of said closure top having an outer periphery at which said central non-planar top region joins said engagement sealing means and an outer region of said closure top extending between said inner engagement sealing means and said closure skirt, said outer closure top region having a downwardly facing surface adapted to engage said container top wall during application of the closure to the container so as to be deformed upon such engagement, said outer closure top region, inner engagement sealing means and central non-planar region of said closure top constituting a mechanism whereby engagement of said downwardly facing surface of said outer closure top region causes said central non-planar top region to flex towards a more planar configuration to thereby urge said outer sealing surface portion of said inner engagement sealing means against the inner sidewall of the open end region of the container, whereby a hermetic sealing of the container by the closure is obtained.

2. The combination of claim 1 wherein said inner engagement sealing means is constituted by an engagement ring having an outer sidewall constituting said outer sealing surface portion spaced radially inwardly from said skirt inner sidewall around substantially its entire circumference to define a substantially circular channel therebetween for receiving the open end region of the container, whereby upon said engagement ring being expanded, said outer sealing surface portion is urged against the inner sidewall of the open end region of the container substantially continuously around its entire circumference.

3. The combination of claim 1 wherein said outer sealing surface portion of said engagement means is constituted by a surface having a high coefficient of friction.

4. The combination of claim 1 wherein said downwardly facing surface of said outer closure top region slopes downwardly in the radially inward direction.

5. The combination of claim 1 wherein said central closure top region includes a substantially convex portion which is deformed as the closure is applied to the container to obtain a less convex configuration whereby as the closure is applied to the container an overpressure is created in said container.

6. The combination of claim 1 wherein said closure skirt is provided with screw threads formed on said inner sidewall thereof adapted to engage corresponding threads provided on the outer sidewall of the container whereby the closure constitutes a screw-type closure.

7. The combination of claim 1 further including a container having an open end region to which the closure is adapted to be applied, said container open end region having outer and inner sidewalls.

8. The combination of claim 7 further including at least one depression formed in said inner sidewall of said container open end region and wherein said engagement means are formed of a pliable material, whereby upon said engagement means being expanded, a portion of said engagement means at least partially enters said at least one depression.

9. The combination of claim 7 wherein said inner sidewall of said container open end region is constituted by a surface having a high coefficient of friction.

10. The combination of claim 7 wherein an upwardly facing shoulder is formed in said inner sidewall of said container open end region and wherein said engagement means when expanded are urged against said inner sidewall and upwardly facing shoulder of said inner sidewall of said container open end region.

* * * * *